US008559833B2

(12) United States Patent
Kawamura

(10) Patent No.: US 8,559,833 B2
(45) Date of Patent: Oct. 15, 2013

(54) IMAGE FORMING APPARATUS INCLUDING REPLENISHING OPERATION FOR DEVELOPER SUPPLY MEMBER

(75) Inventor: Takeshi Kawamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 12/883,495

(22) Filed: Sep. 16, 2010

(65) Prior Publication Data

US 2011/0085807 A1 Apr. 14, 2011

(30) Foreign Application Priority Data

Oct. 8, 2009 (JP) ..... 2009-234004

(51) Int. Cl.
*G03G 15/08* (2006.01)

(52) U.S. Cl.
USPC ..... 399/27; 399/30

(58) Field of Classification Search
USPC ..... 399/27, 30, 61, 258, 260
See application file for complete search history.

(56) References Cited

U.S. PATENT DOCUMENTS 7,912,390 B2 * 3/2011 Mitsui ..... 399/61
2009/0003850 A1 1/2009 Yamamoto et al.
2009/0003884 A1 1/2009 Kawamura et al.

FOREIGN PATENT DOCUMENTS

JP 4-234777 A 8/1992
JP 11-288161 A 10/1999

* cited by examiner

*Primary Examiner* — Hoang Ngo
(74) *Attorney, Agent, or Firm* — Fitzpatrick, Cella. Harper & Scinto

(57) ABSTRACT

An image forming apparatus includes an image bearing member on which an electrostatic latent image is to be formed and a developing device for developing the electrostatic latent image by supplying a developer to the image bearing member. The developing device includes a developer container; a rotatable developer carrying member, including a first electrode member; and a developer supplying member, which includes a surface foam layer and a second electrode member. The apparatus further includes a measuring device for measuring a remaining developer amount in the developer container by detecting electrostatic capacity between the first and second electrode members and a replenishing device for replenishing the developer supplying member by rotating the developer supplying member at a speed slower than a speed during image formation. When the measured remaining developer amount is not more than a threshold, the developer is replenished, and thereafter the remaining developer amount is again measured.

13 Claims, 13 Drawing Sheets

(a)

(b)

(a)

(b)

IMAGE FORMING APPARATUS INCLUDING REPLENISHING OPERATION FOR DEVELOPER SUPPLY MEMBER

FIELD OF THE INVENTION AND RELATED ART

The present invention relates to an image forming apparatus including a measuring device for measuring electrostatic capacity between a developer carrying member for carrying a developer and a developer supplying member for supplying the developer to the developer carrying member to obtain information on a remaining developer amount. This image forming apparatus may preferably be used as an electrophotographic apparatus such as a printer or a copying machine.

In a developing device used in the image forming apparatus such as the electrophotographic apparatus, as a device for detecting a removing amount of the developer (also referred to as toner), that of an antenna type has been known. In this case, an antenna consisting of a metal rod of a stainless steel or the like is provided in parallel to the developer carrying member, such as a developing sleeve, for carrying the toner and supplying the toner to an image bearing member such as an electrophotographic photosensitive member. Then, when a developing bias in the form of a DC voltage biased with an AC voltage is applied to the developer carrying member, a voltage depending on the electrostatic capacity between the developer carrying member and the antenna is induced in the antenna. In this case, the electrostatic capacity the antenna and the developer carrying member is different between a state in which the toner is sufficiently present in the developing device and a gap between the antenna and the developer carrying member is filled with the toner and a state in which the toner in the developing device is consumed and the gap between the antenna and the developer carrying member is not filled with the toner. For this reason, the voltage induced in the antenna is also different. The voltage induced in the antenna is detected by a detector. Then, in a control portion, on the basis of a detected voltage value (depending on the electrostatic capacity), a remaining toner amount in the developing device is computed.

Further, in the developing device using a non-magnetic one component developer (non-magnetic toner) as the developer, the developer supplying member for supplying the toner to the developer carrying member is generally provided in a developing chamber. In the case where the above-described remaining toner amount detecting method utilizing the change in electrostatic capacity is applied to the developing device, due to the presence of the supplying member, there arises a problem such that a space in which the antenna is to be provided is narrow and therefore feeding of the toner is hindered. In order to solve this problem, a method of detecting the remaining toner amount by utilizing the supplying member for supplying the toner to the developer carrying member has been known. The supplying member is constituted by providing a urethane sponge around an electroconductive metal support (electroconductive support). Further, in Japanese Laid-Open Patent Application (JP-A) Hei 4-234777, a method in which a voltage depending on the toner amount is induced in the metal support of the supplying member and then the remaining toner amount is detected by the induced voltage has been proposed. According to the method of JPA Hei 4-234777, there is no need to use a dedicated antenna and thus the method is advantageous in terms of the space and the cost. As a structure of a foam layer of the supplying member, as described in JP-A Hei 11-288161, there is a structure of the foam layer of the supplying member in which an amount of airflow of the foam layer is set at 10 to 400 cc/cm$^2$/sec to prevent toner deterioration and thus a good image quality can be obtained. Incidentally, in JP-A Hei 11-288161, there is no description as to the detection of the remaining toner amount in the developing device.

SUMMARY OF THE INVENTION

The present invention has further developed the above-described conventional constitutions.

A principal object of the present invention is to provide an image forming apparatus capable of detecting an image formable amount of a developer in a developer container with high accuracy even in various use statuses by enabling image formation even in a smaller remaining developer amount.

According to an aspect of the present invention, there is provided an image forming apparatus comprising:

an image bearing member on which an electrostatic latent image is to be formed;

a developing device for developing the electrostatic latent image by supplying a developer to the image bearing member, the developing device including: a developer container for containing the developer; a rotatable developer carrying member, including a first electrode member, for carrying and supplying the developer to the image bearing member; and a developer supplying member, which is provided in contact with the developer carrying member and includes a surface foam layer and a second electrode member for rotatably supporting the developer supplying member, for supplying the developer to the developer carrying member;

a measuring device capable of measuring a remaining developer amount in the developer container by detecting electrostatic capacity between the first electrode member and the second electrode member; and a replenishing device for performing a replenishing operation for replenishing the developer supplying member with the developer by rotating the developer supplying member at a speed slower than that during image formation.

wherein when the remaining developer amount measured by the measuring device is not more than a threshold, the replenishing operation is performed by the replenishing device and thereafter the remaining developer amount is measured again by the measuring device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described more specifically with reference to the drawings. Embodiments described below are used to describe the present invention by way of illustration. Dimensions, materials, shapes, and relative arrangement of constituent parts described in the embodiments do not limit the scope of the present invention unless otherwise specified.

[Embodiment 1]

(1) General Structure of Image Forming Apparatus

Figure 1:
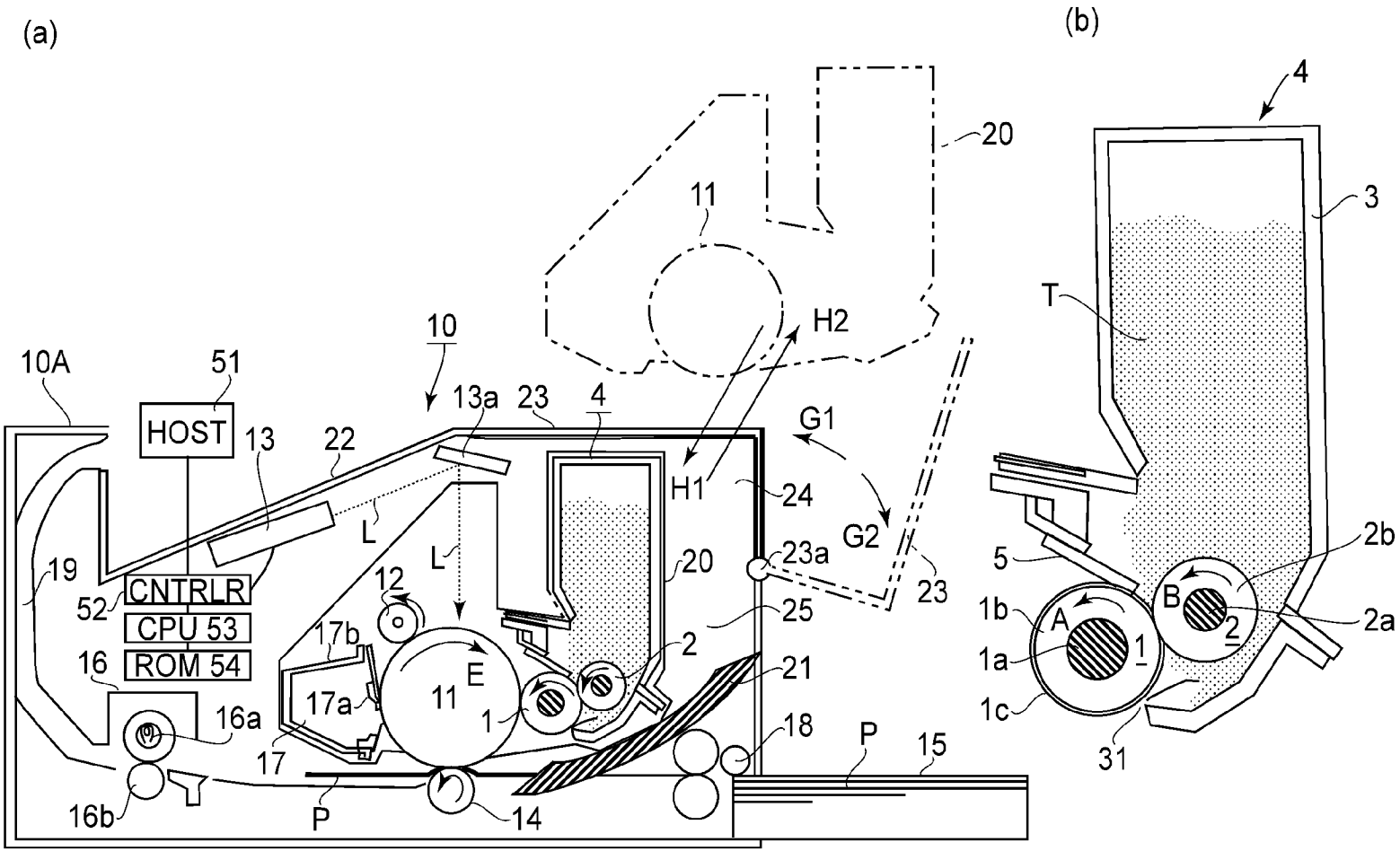
FIG. 1(*a*) is a schematic structural view of an image forming apparatus in Embodiment 1, and FIG. 1(*b*) is an enlarged view of a developing device portion of the image forming apparatus shown in FIG. 1(*a*).

FIG. 1(*a*) is a schematic structural view of an image forming apparatus 10 in this embodiment. This image forming apparatus 10 is a laser beam printer, utilizing a transfer type electrophotographic process, of the type in which a process cartridge is mountable and demountable. The image forming apparatus 10 effects image formation on a sheet-like recording material as a recording medium (recording media) on the basis of an electric image signal input from an external host device 51 such as a personal computer or an image reader into a controller portion (control means) 52 on the image forming apparatus side. The controller portion 52 includes a CPU (computing portion) 53 an ROM (storing means) 54, and the like and transfers various pieces of electrical image information between itself and the host device 51 or an operation portion (not shown) or the image forming apparatus 10. Further, the controller portion 52 effects centralized control of an image forming operation of the image forming apparatus 100 in accordance with a predetermined control program or a predetermined reference table. The image forming apparatus 10 includes a rotatable drum type electrophotographic photosensitive drum 11 as an image bearing member for bearing an electrostatic latent image on its surface (hereinafter referred to as a drum). The image forming apparatus 10 also includes, as process means acting on the drum 11, a charging means 12, an image exposure means (device) 13, a developing means (device) 4, a transfer means 14, and a cleaning means 17. The drum 11 is rotationally driven at a predetermined speed in a clockwise direction indicated by an arrow E by a driving means (not shown) on the basis of an image formation start signal. The charging means 12 electrically charges the surface of the drum 11 to a predetermined polarity and a predetermined potential and as the charging means 12, a charging roller is used in this embodiment. The charging roller 12 is an electroconductive elastic roller and is disposed substantially in parallel to the drum 11. Further, the charging roller 12 contacts the drum 11 with a predetermined urging force and is rotated by the rotation of the drum 11. In this embodiment, a DC voltage of −1000 V is applied to the charging roller 12, so that the drum surface is charged to about −500 V. This charge potential is referred to as a dark portion potential Vd. The image exposure device 13 is a means for forming an electrostatic latent image on the surface of the drum 11. In this embodiment, as the image exposure device 13, a laser optical device (laser scanner unit) is used. The optical device 13 subjects the charged surface of the drum 11 to scanning exposure to laser light L, which has been modulated corresponding to the electrical image information input from the host device 51 into the controller portion 52, output therefrom to the charged drum surface through a reflection mirror 13*a*. Here, the scanning exposure of the drum 11 by the optical device 13 is performed after the dark portion potential Vd of the drum 11 charged by the charging roller 12 is stabilized. The surface potential of the drum 11 at an exposed portion is attenuated by a photoconductive characteristic of the photosensitive member, thus being changed to about −100 V. The thus attenuated potential is referred to as a light portion potential V1. As a result, on the surface of the drum 11, the electrostatic latent image corresponding to a scanning exposure pattern is formed by an electrostatic contrast between the dark portion potential Vd and the light portion potential V1. In this embodiment, an electrostatic latent image forming method is of an image exposure type in which the charged drum surface is exposed to light correspondingly to the image information portion. The developing device 4 visualizes (develops) the electrostatic latent image formed on the drum surface as a developer image (toner image). In this embodiment, the developing means 4 is a reverse-developing device using a non-magnetic one component toner as the developer. The toner is deposited on the exposed portion of the drum 11, so that the electrostatic latent image is reversely developed. The developing device (means) 4 prepares for a developing step of the electrostatic latent image after a developing roller 1 and a supplying roller 2 are rotationally driven by a driving device 56 (FIGS. 4(*a*) and 4(*b*)) provided in the image forming apparatus 10 with predetermined control timing. The developing device 4 will be described later in (4) more specifically.

The transfer means 14 transfers the toner image formed on the drum surface onto a recording material P and in this embodiment, a transfer roller is used as the transfer means 14. The transfer roller 14 is an electroconductive elastic roller and is disposed substantially in parallel to the drum 11. The transfer roller 14 contacts the drum 11 with a predetermined urging force and is rotated by the rotation of the drum 11 or is rotationally driven at the substantially same speed as the speed of the drum 11 in a direction codirectionally with the rotation of the drum 11. On the other hand, one of sheets of the recording material P stacked and accommodated in a cassette 15 is separated and fed by driving a feeding roller 18 with predetermined control timing and is introduced into a transfer nip, which is a press-contact portion between the drum 11 and the transfer roller 14, in which the recording material P is nip-conveyed. To the transfer roller 14, during passing of the recording material P through the transfer nip, a transfer bias which has an opposite polarity (positive in this embodiment) to the charge polarity of the toner and has a predetermined potential is applied. As a result, in a process in which the recording material P is nip-conveyed through the transfer nip, the toner image on the drum 11 is electrostatically transferred successively onto the surface of the recording material P. The recording material P is separated from the surface of the drum 11 after passing through the transfer nip and is introduced into a fixing device 16 in which the recording material P is nip-conveyed in a fixing nip which is a press-contact portion between a fixing roller (heating roller) 16*a* which is a fixing member and a pressing roller 16*b* which is a pressing member. The recording material P is heated and pressed in a process in which the recording material P is nip-conveyed in the transfer nip, so that an unfixed toner image is fixed on the recording material P as a fixed image. The recording material P which has come out of the fixing device 16 passes through a discharging conveyance path 19 and is discharged onto a discharging tray 22 as an image-formed product. Further, the drum surface after the recording material P is separated therefrom at the transfer nip is cleaned by removing a residual deposition product such as a transfer residual toner by using the cleaning means 17, thus being repeatedly subjected to the image formation. In this embodiment, the cleaning means 17 includes a cleaning blade 17*a* as a cleaning member. The residual deposition product on the drum surface is removed and collected by the cleaning blade 17*a* and is contained in a residual toner container 17*b*.

(2) Operation Process of Image Forming Apparatus

Figure 2:
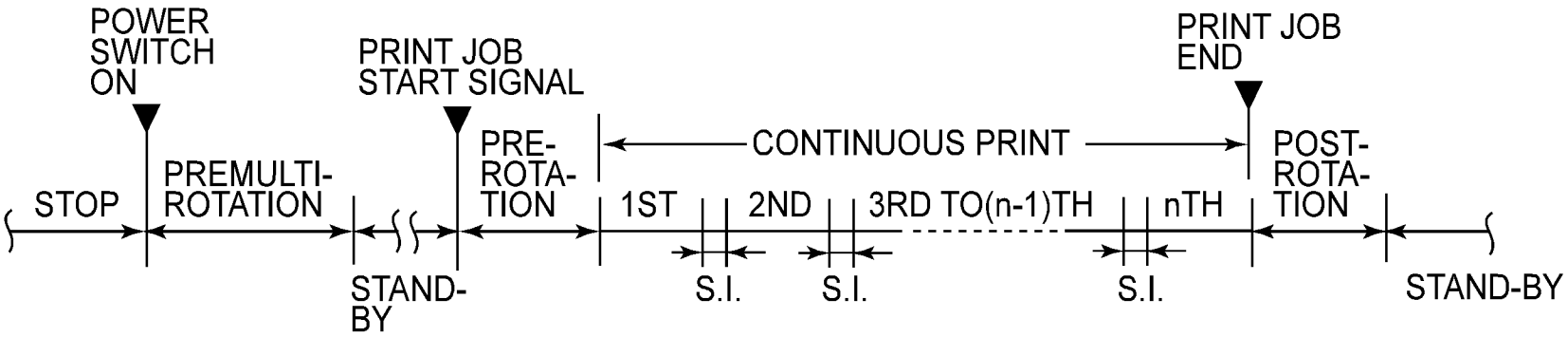
FIG. 2 is an operation process chart of the image forming apparatus shown in FIG. 1(*a*).

FIG. 2 shows an operation process chart of the above-described image forming apparatus.

1) Pre-Multirotation Step

This step is performed in a predetermined start (actuation) operation period (warm-up period) of the image forming apparatus. In this step, a main power switch of the image forming apparatus is turned on to actuate a main motor (not shown) of the image forming apparatus, so that a preparatory rising operation of necessary process equipment is performed.

2) Stand-By

After the predetermined start operation period is ended, the drive of the main motor is stopped and the image forming apparatus is kept in a stand-by state until a print job start signal is input.

3) Pre-Rotation Step

In a period for a pre-rotation step, the main motor is driven again on the basis of the input of the print job start signal to perform a print job pre-operation of necessary process equipment.

In an actual operation, (a) the image forming apparatus receives the print job start signal, (b) an image is decompressed by a formatter (a decompression time varies depending on an amount of image data or a processing speed of the formatter, and then (c) the pre-rotation step is started.

Incidentally, in the case where the print job start signal is input during the pre-multirotation step 1), after the pre-multirotation step 1) is completed, the operation goes to this pre-rotation step 3) with no stand-by 2).

4) Print Job Execution (Image Forming Step)

When the predetermined pre-rotation step is completed, the above-described image forming process is executed, so that a recording material P on which the image has been formed is output. In the case of a successive print job, the image forming process is repeated, a predetermined number of image-formed sheets of the recording material P are output.

5) Sheet Interval Step

This step is a step of an interval between a trailing end of the recording material P and a leading end of a subsequent recording material P in the case of the successive print job. A period for this step corresponds to a non-sheet passing state period at the transfer portion or in the fixing device.

6) Post-Rotation Step

In the case of the print job for one sheet of the recording material P, in this period, the main motor is continuously driven after the image-formed recording material P is output (after the completion of the print job) to execute a print job post-operation of necessary process equipment. Alternatively, in the case of the successive print job, in this period, the main motor is continuously driven after a final image-formed recording material P is output (after the completion of the successive print job) to execute the print job post-operation of necessary process equipment.

7) Stand-By

After the predetermined post-rotation step is completed, the drive of the main motor is stopped and the image forming apparatus is kept in a stand-by state until a subsequent print job start signal is input.

(3) Process Cartridge

In the image forming apparatus 10 in this embodiment, the above-described drum 11 and the process means, acting on the drum 11, including the charging roller 12, the developing device 4 and the cleaning device 17 are integrally assembled into a cartridge, i.e., a process cartridge 20. This cartridge 20 is mountable to and demountable from an image forming apparatus main assembly (an image forming apparatus portion except the process cartridge) 10A. In this embodiment, the mounting and demounting of the cartridge 20 with respect to the apparatus main assembly 10A are performed in a state in which a door 23 provided on the apparatus main assembly 10A to expose an upper surface-side opening 24 of the apparatus main assembly 10A. The door 23 is rotatable about a hinge portion 23*a* between a state in which the door 23 is closed to cover the opening 24 of the apparatus main assembly as indicated by a solid line and a state in which the door 23 is opened to uncover the opening 24 as indicated by a chain double-dashed line. The front side of the image forming apparatus 10 is a side where the hinge portion 23*a* is provided. A reference symbol G1 represents a rotational direction of the door 23 for closing the door 23, and a reference symbol G2 represents a rotational direction of the door 23 for opening the door 23. When the door 23 is opened, the upper surface side opening 24 of the apparatus main assembly 10A is exposed (uncovered), so that a cartridge mounting portion 25 in the apparatus main assembly 10A is in sight. When the inside of the apparatus main assembly 10A is viewed through the opening 24 uncovered by opening the door 23, guides 21 which are provided on left and right sides of the mounting portion 25 so as to extend downward and rearward are in sight. Then, a user holds the cartridge 20 and inserts the cartridge 20 into the mounting portion 25 through the opening 24 in a direction indicated by an arrow H1. Then, portions to be positioned (not shown) on the cartridge 20 side and positioning portions (not shown) on the apparatus main assembly side are engaged with each other, so that the cartridge 20 is mounted at a predetermined mounting position in the apparatus main assembly. Then, the door 23 is closed. In a state in which the cartridge 20 is mounted at the predetermined mounting position, an exposure opening at an upper surface of the cartridge is located opposed to the reflection mirror 13*a* of the optical device 13 at a predetermined position.

Further, a lower surface of the drum 11 contacts the transfer roller 14 at a predetermined position, so that the transfer nip is created. Incidentally, in the case where a drum cover for protecting the lower surface of the drum 11 is provided, the cover is opened and moved in a process in which the cartridge 20 is mounted and moved. Further, the cartridge 20 is placed in a state in which the cartridge 20 is mechanically and electrically connected to the apparatus main assembly 10A. That is, the drum 11, and the developing roller 1 and the supplying roller 2 of the developing device 4 can be driven by the apparatus main assembly-side driving means (not shown). Further, by an apparatus main assembly-side electric energy supplying means (not shown), it becomes possible to apply the charging bias to the charging roller 12 and to apply the developing bias to the developing roller 1. Further, an electrical sensor on the cartridge 20 side and the controller portion 52 on the apparatus main assembly side are placed in an electrically connected state. The demounting of the cartridge 20 from the apparatus main assembly 10A is the reverse of the mounting described above. That is, referring to FIG. 1(*a*), when the door 23 is opened to expose the opening 24 and then the cartridge 20 is pulled out upward and rightward in a direction indicated by an arrow H2 as indicated by the chain double-dashed line, the cartridge 20 is guided by the guides 21 to come out of the apparatus main assembly 10A. In the case where the drum cover is provided, the cover is closed in a process in which the cartridge 20 is moved and pulled out.

(4) Developing Device

FIG. 1(*b*) is an enlarged view of the developing device 4 portion of the image forming apparatus 10 shown in FIG. 1(*a*). This developing device 4 is a reverse developing device using a negatively chargeable non-magnetic one component toner as the developer and includes the developer container 3 for containing the toner T. The developing device 4 further includes the developing roller 1 which is the developer carrying member, the supplying roller 2 which is to be rotated in contact with the developing roller 1 and is used as a developer feeding member for feeding the toner T to the developing roller 1, and a developer regulating member 5 for regulating a layer of the toner T supplied to the developing roller 1 in a small thickness. The developing roller 1 is provided at opening 31 which is provided on a drum opposite side of the developer container 3 and is rotatably supported by the developer container 3. The developing roller 1 is substantially in parallel to the drum 11. The supplying roller 2 is disposed inside the developer container 3 on a side opposite from the drum opposite side of the developing roller 1 and is rotatably supported by the developer container 3 substantially in parallel to the developing roller 1 and in contact with the developing roller 1. The regulating member 5 is fixed on the developer container 3 at its one end portion (base portion) and is disposed in contact with the developing roller 1 at the other end portion, so that the regulating member 5 regulates the layer of the toner T supplied to the developing roller 1 in the small thickness. The regulating member 5 contacts the developing roller 1 counterdirectionally with respect to the rotational direction of the developing roller 1. The supplying roller 2 as the developer feeding member also functions as a detecting member for detecting a remaining toner amount (remaining developer amount) in the developer container 3 (as a remaining developer amount detecting member) as described later. The developing device 4 includes the opening 31 at a lower portion of the developer container 3 so that the self weight of the toner T is applied onto the developing roller 1 and the supplying roller 2 which has been provided at the opening. Such an arrangement is preferable from the viewpoints that the toner is liable to enter the supplying roller 2 and that the remaining toner amount in the developer container 3 is detected with high accuracy.

Here, as the toner used for developing the electrostatic latent image, in this embodiment, the toner having the negative charge polarity as a normal charge polarity which is the charge polarity possessed by most of the toner. Further, cohesion (agglomeration degree) of the toner in this embodiment is 15%. The toner cohesion was measured in the following manner. As a measuring device, a power tester (mfd. by Hosokawa Micron Group) including a digital vibration meter ("Model 1332", mfd. by Showa Sokki Corp.) was used. For measurement, a 390-mesh sieve, a 200-mesh sieve, and a 100-mesh sieve were superposed and set in the order of narrow aperture, i.e., in the order of the 390-mesh sieve, the 200-mesh sieve, and the 100-mesh sieve from the bottom so that the 100-mesh sieve is located at an uppermost position. On the thus set 100-mesh sieve, 5 g of a sample (toner) which had been accurately weighed was added and then a value of displacement of the digital vibration meter was adjusted at 0.60 mm (peak-to-peak), followed by vibration application for 15 seconds. Thereafter, the weight of the sample remaining on each of the sieves was measured and the cohesion was obtained on the basis of an equation shown below. The measurement sample was left standing for 24 hours before the measurement in an environment of 23° C. and 60% RH and was then subjected to the measurement in the environment of 23° C. and 60% RH.

Cohesion (%)=((remaining sample weight on 100-mesh sieve)/5 g)×100+((remaining sample weight on 200-mesh sieve/5 g)×60+((remaining sample weight on 390-mesh sieve)/5 g)×20

The developing roller 1 is prepared by providing a semiconductive elastic rubber layer 1*b*, in which an electroconductive agent is contained, around an electroconductive support 1*a*, and is constituted so that the developing roller 1 is rotated in a direction indicated by an arrow A in FIG. 1(*b*) (i.e., in the same (codirectional) direction with respect to the rotational direction E of the drum 11 at the contact portion between the developing roller 1 and the drum 11 shown in FIG. 1(*a*)). Specifically, the developing roller 1 includes a core electrode 1*a* (first electrode member) which is the electroconductive support and has an outer diameter of 6 mm, and includes a semiconductive silicone rubber layer 1*b* which is provided around the core electrode 1*a* and contains therein the electroconductive agent. Further, on the silicone rubber layer 1*b*, as a surface layer, an acrylic urethane rubber layer 1*c* having a thickness of about 20 μm is coated, so that an outer diameter of the entire developing roller 1 is 12 mm. Further, in this embodiment, a resistance of the developing roller 1 is $1\times10^6$ ohm. Here, a measuring method of the resistance of the developing roller 1 will be described. The developing roller 1 is caused to contact an aluminum sleeve of 30 mm in diameter with a contact load of 9.8N. By rotating this aluminum sleeve, the developing roller 1 is rotated at 60 rpm. Then, a DC voltage of −50 V is applied to the developing roller 1. At that time, a resistance of 10 kΩ is provided on a ground side, and a voltage at both ends is measured to calculate a current, so that the resistance of the developing roller 1 is calculated. Incidentally, when a volume resistance of the developing roller 1 is larger than $1\times10^9$ ohm, a voltage value of the developing bias at the developing roller surface is lowered and a DC electric field in the developing area is decreased, so that a developing efficiency is lowered and therefore there arises a phenomenon that an image density is lowered. Therefore, the resistance of the developing roller 1 may preferably be not more than $1\times10^9$ ohm.

The supplying roller 2 which is the developer feeding member and is used as the remaining developer amount detecting member includes an electroconductive support 2*a* and a foam layer 2*b* supported by the electroconductive support 2*a*. Specifically, around the core electrode 2*a* (second electrode member) which is the electroconductive support and has an outer diameter of o5 mm, the urethane foam layer 2*b* which is the foam layer constituted by an open-cell foam (interconnected cell) in which air bubbles are connected to each other is provided. The supplying roller 2 is constituted so as to be rotated in a direction indicated by an arrow B in FIG. 1(*b*) (i.e., in the counter direction with respect to the rotational direction A at the contact portion between the supplying roller 2 and the developing roller 1. The outer diameter of the entire supplying roller 2 including the urethane foam layer 2*b* is 13 mm. By constituting the surface urethane layer as the open-cell foam, the toner can enter the inside of the supplying roller 2 in a large amount, so that it becomes possible to improve a performance of detection of the remaining toner amount described later. Further, in this embodiment, the resistance of the supplying roller 2 is $1\times10^9$ ohm. Here, the measuring method of the resistance of the supplying roller 2 will be described. The supplying roller 2 is caused to contact the aluminum sleeve of 30 mm in diameter so that an entering amount described later is 1.5 mm. By rotating this aluminum sleeve, the supplying roller 2 is rotated at 30 rpm. Then, to the developing roller 1, the DC voltage of -50 V is applied. At that time, a resistance of 10 kΩ is provided on the ground side and the voltage at both ends is measured to calculate the current, so that the resistance of the supplying roller 2 is calculated. A surface cell diameter of the supplying roller 2 was 50 μm to 1000 μm. Here, the cell diameter means an average diameter of the foam cell at an arbitrary cross section. A maximum area of the foam cell is measured from an enlarged image at the arbitrary cross section and is converted into an equivalent perfect circle diameter to obtain the maximum cell diameter. A portion of the foam cell which is ½ or less of the maximum cell diameter is deleted as noise and thereafter individual cell diameters are obtained by converting individual cell areas of a remaining portion of the foam cell, so that the cell diameter is obtained as an average of the individual cell diameters. The supplying roller 2 used had a surface airflow amount of 1.8 liters/minute or more.

Figure 3:
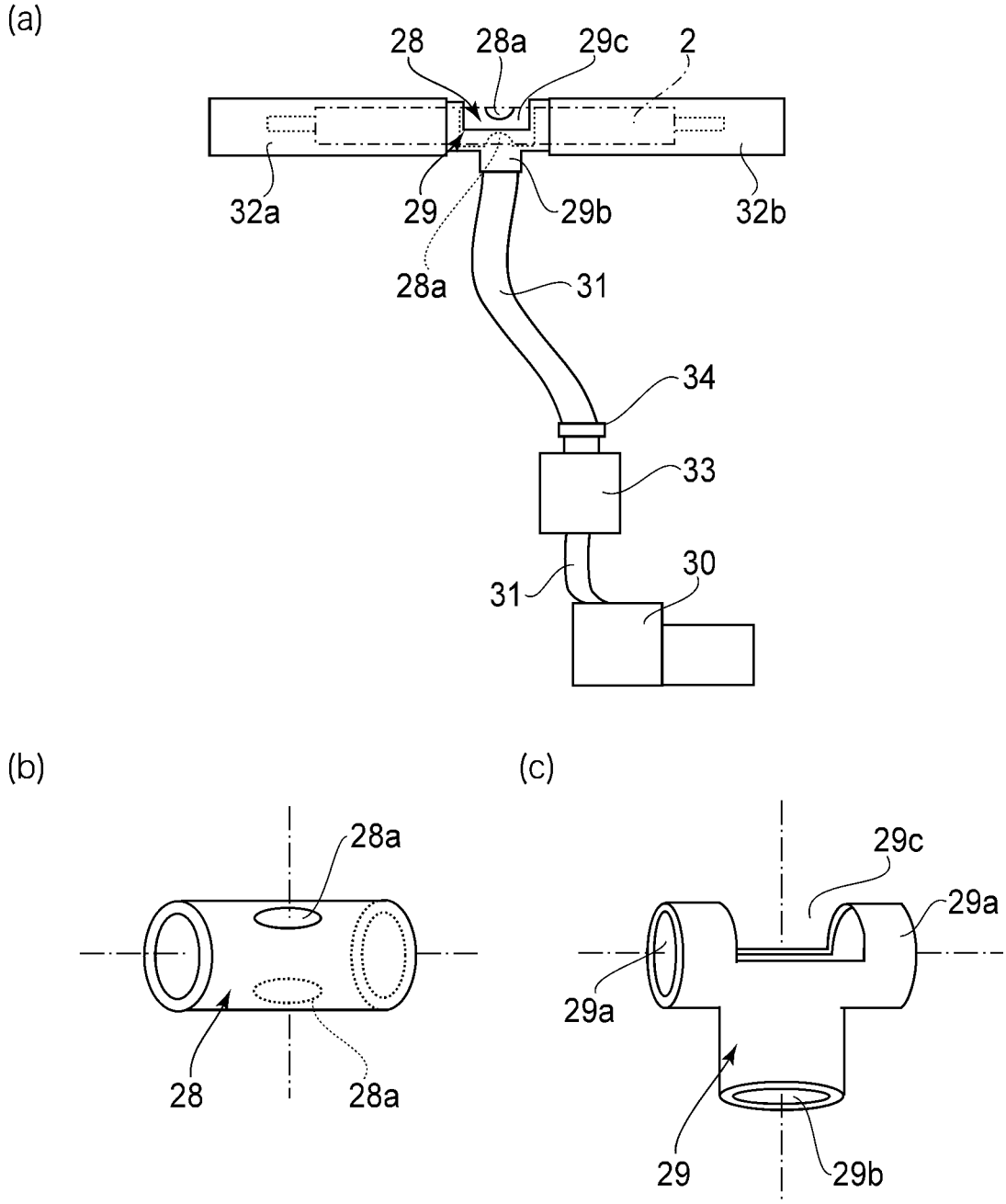
FIGS. 3(*a*) to 3(*c*) are schematic views for illustrating a measuring method of a surface airflow amount of a supplying roller.

The surface airflow amount of the supplying roller 2 in this embodiment will be described more specifically. FIG. 3(*a*) is a schematic view for illustrating the measuring method of the surface airflow amount. First, the supplying roller 2 in this embodiment is inserted into a measuring jig 28 as shown in FIG. 3(*b*). The measuring jig 28 is prepared by providing a through hole 28*a* of 10 mm in diameter which penetrates through a side surface of a hollow cylindrical member so that a center axis of the through hole 28*a* and an axis of the cylinder are perpendicular to each other. An inner diameter of the hollow cylindrical member used is 1 mm smaller than the outer diameter of the supplying roller 2 to be measured. This is because a gap between the inner surface of the cylindrical member of the measuring jig 28 and the outer surface of the supplying roller 2 to be measured is eliminated. The supplying roller 2 in this embodiment has the outer diameter of 13 mm and therefore the inner diameter of the measuring jig 28 is 12 mm. The measuring jig 28 in which the supplying roller 2 has been inserted is attached to a ventilation holder 29 as shown in FIG. 3(*c*). The ventilation holder 29 has a T shape such that a hollow cylindrical member 29*a* is connected at its side surface to a connecting pipe 29*b* to which a ventilation pipe 31 communicating with a pressure reducing pump 30 is to be attached, and has such a shape that a portion 29 opposite from the connected portion of the connecting pipe 29*b* has been considerably cut away. The inner diameter of the connecting pipe 29*b* is set so as to be larger than the diameter of the through hole 28*a*. In this embodiment, the inner diameter of the connecting pipe 29*b* was set at 12 mm. The inner diameter of the hollow cylindrical member 29*a* of the ventilation holder 29 has the substantially same dimension as the outer diameter of the measuring jig 29, so that the measuring jig 28 can be inserted into the hollow cylindrical member 29*a*. As shown in FIG. 3(*a*), one end of the through hole 29*a* is entirely exposed to the cut-away portion 29*c* of the hollow cylindrical member 29*a*, and the other end of the through hole 28*a* is provided substantially opposed to the inner diameter portion of the connecting pipe 29*b*. On left and right sides of the hollow cylindrical member 29*a* of the ventilation holder 29, as shown in FIG. 3(*a*), acrylic pipes 32*a* and 32*b* each of which is connected to the hollow cylindrical member 29*a* at one end and is stopped up at the other end are provided. The supplying roller portions extending from left and right ends of the measuring jig 28 are accommodated in the acrylic pipes 32*a* and 32*b*.

At intermediate portions of the ventilation pipe 31, a flowmeter 33 ("KZ Type Air Permeability Tester", mfd. by Daiei Kagaku Seiki Mfg. Co., Ltd.) and a different pressure control valve 34 are provided. When the inside air of the ventilation pipe 31 is evacuated by the pressure reducing pump 30, the ambient air is prevented from entering the inside of the ventilation pipe 31 through a portion except the through hole 28*a* of the exposed measuring jig 28. That is, connecting portions of the measuring jig 28, the ventilation holder 29, the ventilation pipe 31 and the acrylic pipes 32*a* and 32*b* are sealed with a tape or grease. The surface airflow amount is mounted in the following manner. First, referring to FIG. 3(*a*), in a state in which the supplying roller 2 is not disposed, the pressure reducing pump 30 is actuated and the pressure is adjusted by the differential pressure control valve 34 so that a measured value of the flowmeter 33 is stable and is 10.8 liters/min. Thereafter, the supplying roller 2 which is an object to be measured is disposed and is carefully sealed as described above, and then the measured value of the flowmeter 33 under the same evacuation condition as that described above is taken as the surface airflow amount. The surface airflow amount is taken as a value at the time when the measured value of the flowmeter 33 is sufficiently stabilized. The airflow which will pass through the supplying roller 2 enters the urethane foam layer 2*b*, located at the through hole 28*a* when the measuring jig 28 is exposed, from the surface of the urethane foam layer 2*b* and passes through the inside of the urethane foam layer 2*b* and then comes outs of the surface of the urethane foam layer 2*b* located at the other-side through hole 28*a* of the measuring jig 28. The surface of the urethane foam layer 2*b* of the supplying roller 2 in general is different from the inside of the urethane foam layer 2*b* in many cases. For example, in the case where the supplying roller 2 is formed by in-mold foaming, a skin layer different in surface cell aperture ratio from the inside can appear at the surface. Further, the urethane foam layer which has the surface which has not been formed simply as a cylindrical surface but has been intentionally provided with projections and recesses is also present. The toner powder fluid which enters and comes out of the inside of the urethane foam layer 2*b* can be influenced by the above-described surface state, so that behavior thereof cannot be grasped only by measurement of bulk airflow amount as defined in JIS-L 1096. Therefore, in this embodiment, the airflow amount measuring method for measuring the airflow which enters and comes out of the surface of the urethane foam layer 2*b* as described above is employed and the measured airflow amount is used as a principal parameter for creating an equilibrium state of the above-described toner powder fluid (or a state close thereto).

As described above, the developing roller 1 is rotated in the direction indicated by the arrow A in FIG. 1(*b*) and the supplying roller 2 is rotated in the direction indicated by the arrow B in FIG. 1(*b*), and a distance between rotation axes of the rollers 1 and 2 is set at 11 mm. With respect to hardness of the urethane foam layer 2*b* of the supplying roller 2, the urethane foam layer 2*b* is sufficiently softer than the silicone rubber layer 1*b* and the acrylic urethane rubber layer 1*c* of the developing roller 1. For that reason, the surface of the developing roller 1 contacts the supplying roller 2 in a state in which the urethane foam layer 2*b* is deformed by 1.5 mm at the maximum. The maximum deformation amount is a maximum distance between a position of the surface of the urethane foam layer 2*b* when the developing roller 1 is not brought into contact with the urethane foam layer 2*b* and a position of the surface of the urethane foam layer 2*b* when the developing roller 1 is brought into contact with the urethane foam layer 2*b* during normal operation. This maximum deformation amount is referred to as the entering amount of the developing roller 2 with respect to the supplying roller 2. In this embodiment, the rotational speed of the developing roller 1 is 130 rpm and the rotational speed of the supplying roller 2 is 100 rpm. The driving means 56 (FIGS. 4(*a*) and 4(*b*)) is controlled by the controller portion 52 through a driver 57. A driving force of the driving means 56 is transmitted to the developing device 4 through a drive transmitting means (not shown), so that the developing roller 1, the supplying roller 2, a stirring member 6 (FIG. 11) and the like are driven in a predetermined directions at predetermined rotational speeds. With the rotation of the developing roller 1 and the supplying roller 2, the urethane foam layer 2*b* of the supplying roller 2 is deformed by the developing roller 1 at the contact portion therebetween. At this time, the toner T held in the surface layer of or inside the urethane foam layer 2*b* of the supplying roller 2 is discharged from the surface layer of the urethane foam layer 2*b* and a part thereof is transferred onto the surface of the developing roller 1. The toner which is transferred on the surface of the developing roller 1 is uniformly regulated on the developing roller 1 by a regulating blade 5 which is a developer regulating member and is provided downstream of the contact portion with respect to the rotational direction of the developing roller 1 while contacting the developing roller 1. In the above process, the toner T is rubbed at the contact position between the developing roller 1 and the developing roller 2 or at a regulation portion between the developing roller 1 and the regulating blade 5, thus obtaining desired triboelectric charges (negative charges in this embodiment). Further, the developing roller 1 and the supplying roller 2 are rotated in the opposite directions at their contact portion, so that the development residual toner on the developing roller 1 is removed by the supplying roller 2.

Here, this embodiment is characterized in that rotational speeds of the developing roller 1 and the supplying roller 2 in a replenishing operation described later are slower than those described above.

Figure 4:
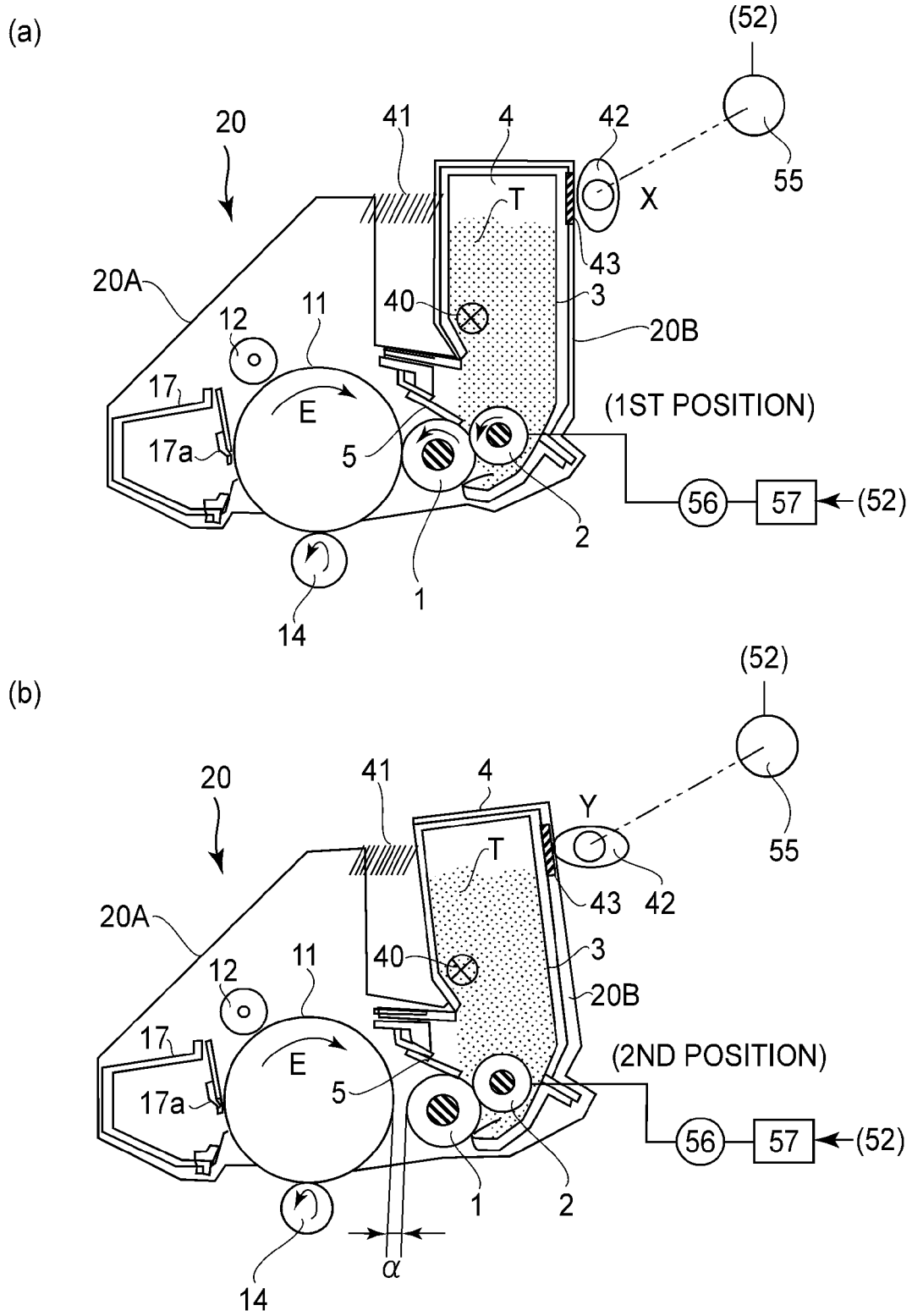
FIGS. 4(*a*) and 4(*b*) are schematic views for illustrating a swinging mechanism for a developing device.

The cartridge 20 has a constitution, as shown in FIGS. 4(*a*) and 4(*b*), in which the developing device 4 is connected, swingably about a supporting shaft portion 40 as a developing unit 20B, to a drum unit 20A including the drum 11, the charging roller 12 and the cleaning device 17. Between the drum unit 20A and the developing unit 20B, an urging spring 41 is provided. The developing unit 20B is, in a free state, rotationally urged about the supporting shaft portion 40 in a direction in which the developing roller 1 of the developing device 4 contacts the drum 11 by an expansion (stretching) force of the spring 41. As a result, the developing roller 1 is held in a state in which the developing roller 1 contacts the drum 11 with a predetermined urging force. With respect to the cartridge 20, the drum unit 20A is positioned and held at an apparatus main assembly-side positioning portion in a state in which the cartridge 20 is mounted in a mounting portion 25 in a predetermined manner. The developing unit 20B is swingable about the supporting shaft portion 40 with respect to the drum unit 20A. At a rear surface of the developing unit 20B, a force receiving portion 43 is provided. An apparatus main assembly-side spacing cam 42 is constituted so as to be positioned correspondingly to the force receiving portion 43. The spacing cam 42 is subjected to 90-degree intermittent rotation control by a driving device 55 controlled by the controller portion 52, so that the attitude of the spacing cam 42 is switched between a vertical rotation angle attitude X as shown in FIG. 4(*a*) and a horizontal rotation angle attitude Y as shown in FIG. 4(*b*). As shown in FIG. 4(*a*), in a state in which the spacing cam 42 is switched into the vertical rotation angle attitude X, the spacing cam 42 is in non-contact with the force receiving portion 43. In this state, the developing unit 20B is in the free state, in which the developing roller 1 is rotationally urged about the supporting shaft portion 40 in the direction in which the developing roller 1 contacts the drum 11 by the expansion force of the spring 41. As a result, the developing roller 1 is held in the state in which the developing roller 1 contacts the drum 11 with the predetermined urging force. Thus, a contact position of the developing device 4 in which the developing roller 1 is placed in the contact state with the drum 11 is referred to as a first position (developing position). As shown in FIG. 4(*b*), in the state in which the spacing cam 42 is switched into the horizontal rotation angle attitude Y, a cam surface of the cam 42 pushes the force receiving portion 43 located at the rear surface of the developing roller 4. As a result, while the developing device 4 compresses the spring between itself and the drum unit 20A against the expansion force of the spring 41, the developing roller 1 is rotated about the supporting shaft portion 40 in a direction in which the developing roller 1 is spaced from the drum 11 by a distance α. A spacing drum of the developing device 4 in which the developing roller 1 is placed in the state in which the developing roller 1 is spaced from the drum 11 by the distance α is referred to as a second position (non-developing position). At this position, a developing operation is not performed. The force receiving portion 43 has performances such as a surface sliding performance necessary during the contact rotation with the spacing cam 42 and a hardness such that the force receiving portion 43 is not deformed in the spacing state which is a state in which a maximum force is applied to the force receiving portion 43 in this embodiment. Here, the drive of the developing roller 1, the supplying roller 2, the stirring member (FIG. 11) and the like by the driving means 56 is constituted so that the drive can be effected also in the state in which the developing device 4 has been moved to the second position (non-developing position).

The developing device 4 of the cartridge 20 in the state in which the cartridge 20 is mounted in the apparatus main assembly 10A is held at the above-described second position during the normal operation. The controller portion 52 controls the driving means 55 so that the position of the developing device 4 is switched from the second position to the first position with predetermined control timing after the print start signal is input. Then, to the developing roller 1, a DC voltage of −300 V is applied as the developing bias from a power source portion with predetermined timing. At the first position of the developing device 4, the developing roller 1 and the photosensitive drum 11 contact each other and the electrostatic latent image formed on the drum 11 is developed. After the development of the electrostatic latent image is completed, the controller portion 52 controls the driving means 55 so that the position of the developing device 4 is switched from the first position to the second position. At the same position, the controller portion 52 stops the rotational drive of the developing roller 1 and the supplying roller 2 and also stops the application of the developing bias to the developing roller 1.

(5) Detection of Remaining Toner Amount in Developing Device 4

Figure 5:
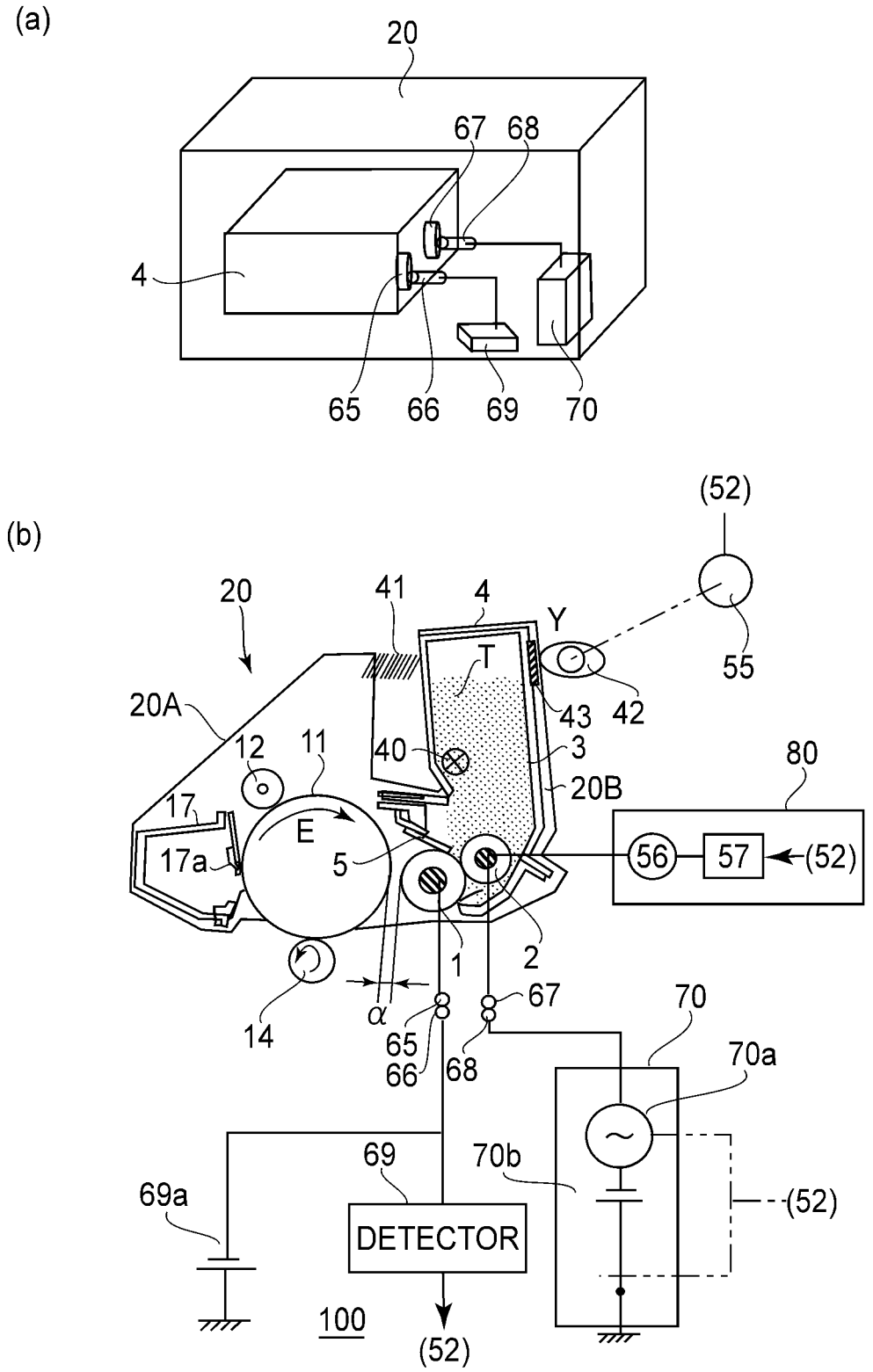
FIGS. 5(*a*) and 5(*b*) are schematic views for illustrating a remaining developer amount measuring device which utilizes a change in electrostatic capacity.

In this embodiment, at the second position (non-developing position) in which the developing roller 1 is spaced from the drum 11, the remaining toner amount in the developer container 3 is measured by detecting the electrostatic capacity between the core metal electrode 1*a* of the developing roller 1 and the core metal electrode 2*a* of the supplying roller 2 by a remaining developer amount measuring device (remaining toner amount measuring device). That is, the detection of the remaining toner amount in the developing device 4 is performed. A remaining toner amount detecting method utilizing a change in electrostatic capacity in this embodiment will be described with reference to FIGS. 5(*a*) and 5(*b*). FIG. 5(*a*) is a schematic view showing a state in which the developing device 4 in this embodiment is disposed in the image forming apparatus 10. FIG. 5(*b*) is a block circuit diagram of a remaining toner amount detecting system. A contact electrode 65 attached to the developing device 4 is electrically connected to the core metal electrode 1*a* of the developing roller 1. As an electrode corresponding to the electrode 65, a contact electrode 66 is provided on the apparatus main assembly side of the image forming apparatus 10. The electrode 66 is connected to an electrostatic capacity detecting device (detector) 69 inside the apparatus main assembly of the image forming apparatus 10 and is connected to a DC bias voltage source (developer carrying member voltage applying means) 69*a* for the developing roller 1. Similarly, a contact electrode 67 which is attached to the developing device 4 and is electrically connected to the core electrode 2*a* of the supplying roller 2, and a corresponding contact electrode 68 on the apparatus main assembly side of the image forming apparatus 10 are provided. The electrode 68 is connected to a power source (developer carrying member voltage applying means) 70 for detection provided inside the apparatus main assembly of the image forming apparatus 10. The power source 70 includes an AC bias voltage source 70*a* for detection and a DC bias voltage source 70*b* for the supplying roller 2. The voltage source 70*b* is a power source capable of applying a negative bias. In the state in which the cartridge 20 is mounted at a predetermined position in the apparatus main assembly 10A, the electrodes 65 and 66 are electrically connected to each other and the electrodes 67 and 68 are electrically connected to each other even when the developing device 4 is switched into the first position and even when the developing device 4 is switched into the second position. That is, even when the developing device 4 is swung between the first position and the second position, the electrodes t65 and 66 still contact each other and the electrodes 67 and 68 still contact each other.

During a normal developing operation (during image formation), the developing device 4 is located at the first position and the developing bias (DC voltage) of −300 V is applied from a power source 69*a* to the electrode 65 through the electrode 66. That is, to the developing roller 1, the developing bias of −300 V is applied. At this time, in the power source 70, the AC bias voltage source 70*a* for detection is controlled to be turned off and the DC bias voltage source 70*b* for the supplying roller 2 is controlled to be turned on, so that the DC voltage of −300 V which is equal to the developing bias is applied to the electrode 67 through the electrode 68. That is, the DC voltage of −300 V which is equal to the developing bias is applied to the supplying roller 2. As a result, during the developing operation, the electrode 65 and the electrode 67 has the same potential, so that the electric field is not created between the developing roller 1 and the supplying roller 2.

During a non-developing operation (during non-image formation), the developing device 5 is located at the second position. In this embodiment, in the state in which the developing device 4 is switched into the second position, the remaining toner amount in the developing device 4 is detected by applying a remaining toner amount detecting bias (remaining developer amount detecting voltage) from the voltage source 70*a* to the electroconductive core metal 2*a* of the supplying roller 2. As the remaining toner amount detecting bias, an AC bias of 50 kHz in frequency and 200 V in peak-to-peak voltage (Vpp). At this time, the voltage source 70*b* and 69*b* are controlled to be turned off. In the electroconductive core metal 1*a* of the developing roller 1, a voltage is induced by the remaining toner amount detecting bias applied to the supplying roller 2 and is detected by the detector 69. That is, the detector 69 detects the electrostatic capacity between the core metal electrode 1*a* of the developing roller 1 and the core metal electrode 2*a* of the supplying roller 2 on the basis of the detected voltage. Then, electrical information on the detected electrostatic capacity value is input into the controller portion 52. The controller portion 52 computes and determines the remaining developer amount in the developing device 4 from the electrical information, on the detected electrostatic capacity value input from the detector 69, and from a correlation table data between electrostatic capacity values and remaining toner amounts which have been measured and stored in advance. In the above, the detector 69 and the controller portion 52 constitute a remaining developer amount measuring device 100. That is, the remaining developer amount measuring device 100 is capable of measuring the remaining toner amount in the developer container 3 by detecting the electrostatic capacity between the core metal electrode 1*a* of the developing roller 1 and the core metal electrode 2*a* of the supplying roller 2 under application of the voltage from the power source 70 to the supplying roller 2 during the non-image formation.

At the second position of the developing device 4 in which the developing operation, i.e., in the state in which the drum 11 and the developing roller 1 are spaced from each other with the distance α, the developing device 4 is in a non-developing operation period. Specifically, such a period can be realized, e.g., at a sheet interval in which the image formation is not effected. Further, the period can be realized during a preparatory operation before start of the image formation. Further, the period can be realized in an apparatus operation from completion of an image forming process to discharge of the recording material P from the image forming apparatus to the outside of the image forming apparatus (a so-called post-rotation), or the like. In this period, at the second position of the developing device 4, the drum 11 and the developing roller 1 are spaced from each other with the distance α. For that reason, even when the AC bias is applied to the supplying roller 2 as the remaining toner amount detecting bias, there is no occurrence of white background contamination which is called fog. Further, there is also no occurrence of unpleasant impact noise when the developing roller 1 and the supplying roller 2 impact each other during contact thereof to cause vibration. The developing roller 1 is used as an antenna for electrostatic capacity detection by applying an AC bias, for the purpose of detecting the remaining toner amount, to the electroconductive core metal 2*a* of the supplying roller 2, so that it is possible to prevent toner feeding inhibition which occurs in a constitution in which a separate antenna is provided in a developing chamber. By a contact and separation operation between the drum 11 and the developing roller 11, i.e., movement of the developing device 4 between the first position in which the developing operation is performed and the second position in which the developing operation is not performed, the attitude of the developing device 4 is changed and correspondingly the toner is moved. At this time, in the developing device 4 in this embodiment, the voltage source 70*a* applies the AC bias for the remaining toner amount detection to the supplying roller 2 and the developing roller 1 is used as the antenna for the electrostatic capacity detection, so that a change in electrostatic capacity of the toner contained in the supplying roller 2. Therefore, the amount of the toner contained in the supplying roller 2 is not changed by the change in attitude of the developing device 4 and the movement of the toner T accompanying the contact and separation operation. That is, the amount of the toner present between the developing roller 1 and the supplying roller 2 is not changed, so that output of the voltage induced in the antenna is not changed. Specifically, the supplying roller 2 includes the foam layer which permits entry of the toner into the inside of the foam layer and thus the toner in the foam layer is less liable to move even when the attitude of the developing device 4 is changed, so that the output of the voltage is not changed. In addition, in the non-magnetic one component contact developing device 4 in this embodiment, when the remaining toner amount detection utilizing the electrostatic capacity, i.e., in the state in which the developing roller 1 and the drum 11 are spaced from each other with the distance $\alpha$, the drive of the developing roller 1 and the supplying roller 2 is stopped. By stopping the drive of the developing roller 1 and the supplying roller 2, the toner feeding to the developing roller 1 and the removal of the toner which has not been subjected to the development are interrupted and thus the amount of the toner contained in the supplying roller 2 is constant during the remaining toner amount detection, so that accuracy of the remaining toner amount detection can be enhanced.

Figure 6:
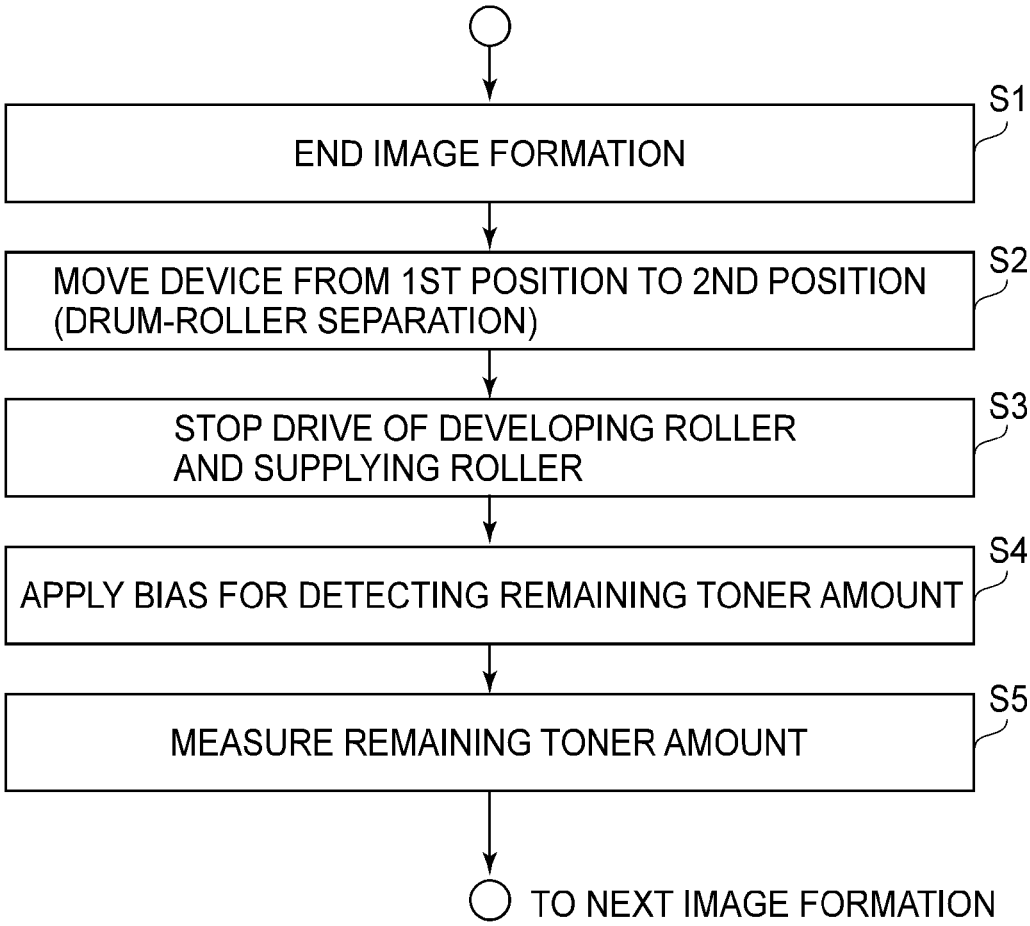
FIG. 6(*a*) is a flowchart of remaining toner amount detection, and FIG. 6(*b*) is a graph showing a relationship between a remaining toner amount in the developing device and a toner amount incorporated in the supplying roller.
Figure 6:
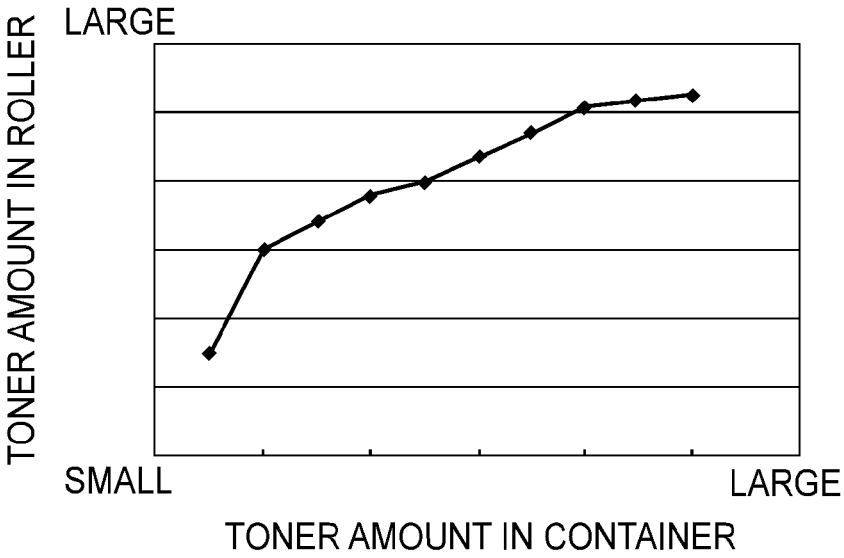

FIG. 6(*a*) shows a flowchart of the remaining toner amount detection in this embodiment. With respect to timing of the remaining toner amount detection, after the image forming operation is completed (step S1), a spacing operation between the photosensitive drum 11 and the developing roller 1 is performed by moving the developing device 4 from the first position to the second position (step S2). Then, the drive of the developing roller 1 and the supplying roller 2 is stopped (step S3). Thereafter, the remaining toner amount detecting bias is applied to the supplying roller 2 (step S4), so that the remaining toner amount detection is performed (step S5).

Figure 7:
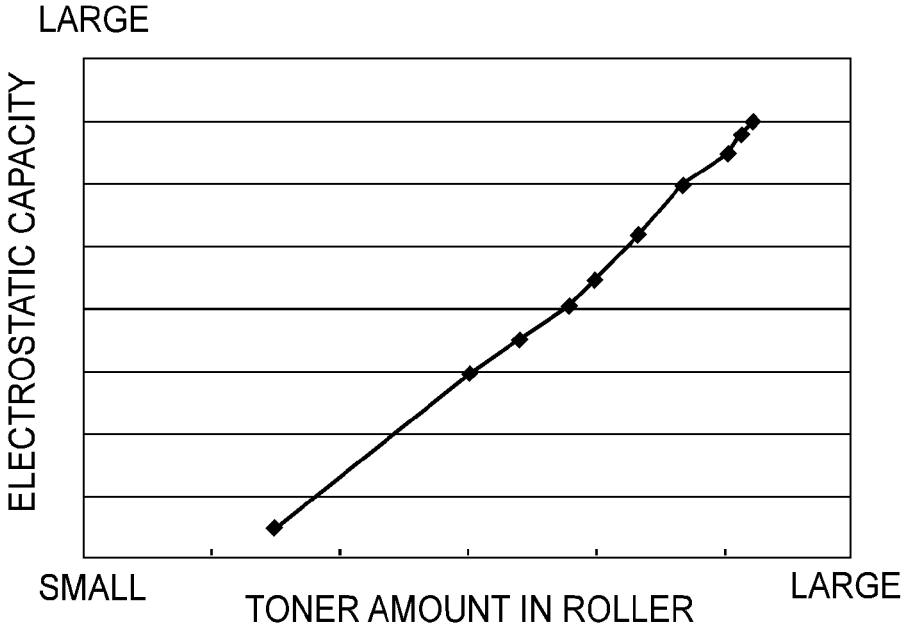
FIG. 7(*a*) is a graph showing a relationship between a remaining toner amount in the developing device and an output of an electrostatic capacity detector, and FIG. 7(*b*) is a graph showing a relationship between the toner amount incorporated in the supplying roller and a toner amount incorporated in the supplying roller.
Figure 7:
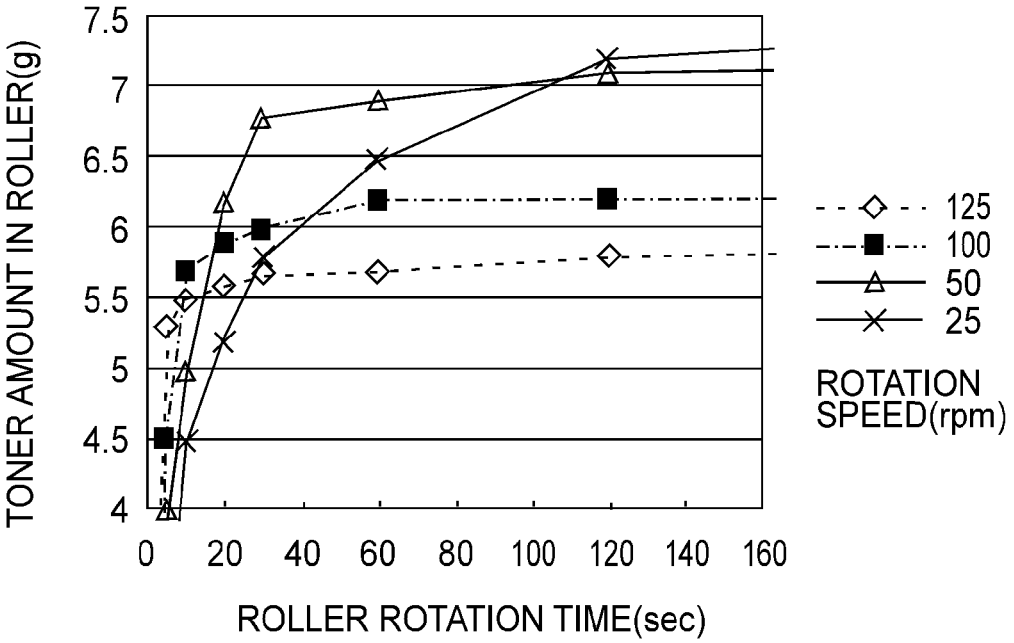

FIG. 6(*b*) is a plot of a remaining amount of the toner T in the developing device 4 (in the developer container) and an amount of the toner contained in the supplying roller 2 at that time in Embodiment 1. In FIG. 6(*b*), the toner T was filled in the developing device 4 in this embodiment and was gradually consumed and then the electrostatic capacity was measured at each of different remaining toner amounts. Thereafter, the supplying roller 2 was taken out and the amount of the toner T contained in the supplying roller 2 was measured. That is, a difference in weight between the supplying roller 2 before use and the supplying roller 2 after use was taken. As shown in FIG. 6(*b*), it is understood that the remaining toner amount in the developing device and the amount of the toner contained in the supplying roller are changed while keeping a good correlation which is relatively linear. In the above measurement, output values of the electrostatic capacity of the developing device 4 and the amounts of the toner contained in the supplying roller 2 at that time in Embodiment 1 were plotted in FIG. 7(*a*). As shown in FIG. 7(*a*), the amounts of the toner contained in the supplying roller (the remaining toner amounts in the developing device) and the electrostatic capacity output values keep a very good correlation which is substantially linear. This shows that the change in electrostatic capacity in the supplying roller 2 is accurately measured by the constitution in this embodiment.

With an increasing airflow amount in the supplying roller 2, there is a tendency that an absolute value of the electrostatic capacity detection output value is increased. With respect to the amount of change depending on the remaining toner amount in the developing device, when the supplying roller has the airflow amount of 1.8 liters/min., a correlation between the detected electrostatic capacity output value and the remaining toner amount in the developer container is good, so that detection accuracy of the remaining toner amount is further enhanced. Further, when the airflow amount is large, a pore portion of the foam layer of the supplying roller 2 is increased and a strength of the supplying roller 2 is decreased, so that the foam layer of the supplying roller 2 is liable to broken. In order to prevent the breaking of the foam layer, the airflow amount may preferably be 5 liters/min. or less. As a result, the range of the airflow amount in the supplying roller 2 may preferably be from 1.8 liters/min. to 5 iters/min.

The toner in the supplying roller 2 is partly discharged when the supplying roller 2 is started to be deformed at the time of start of the contact of the supplying roller 2 with the developing roller 1 and is partly inhaled when the deformation of the supplying roller 2 is eliminated (i.e., the deformed shape of the supplying roller 2 is returned to the original shape) at the time of end of the contact of the supplying roller 2 with the developing roller 1. Thus, the toner T enters and comes out of the supplying roller 2 but the amount of the toner in the supplying roller is generally kept in the equilibrium state unless the remaining toner amount in the developer container is changed. In order to measure the above-described electrostatic capacity output value with high accuracy when the amount of the toner in the supplying roller is judged more properly, as described above, the output value may preferably be measured after the rotation of the supplying roller 2 is stopped so as not to cause the entry of the toner into the supplying roller and the exit of the toner from the supplying roller.

The correlation between the remaining toner amount in the developing device and the amount of the toner contained in the supplying roller shown in FIG. 6(*b*) depends on the cohesion (agglomeration degree) of the toner T. With a lower cohesion, the entry and exit of the toner with respect to the supplying roller become easy, so that it is considered that the correlation between the remaining toner amount in the developing device and the amount of the toner contained in the supplying roller becomes good. When the image forming operation was performed in the image forming apparatus 10 in this embodiment and the cohesion of the toner T remaining in the developer container in a state in which the toner T in the developing device was sufficiently consumed was measured, the cohesion was 30%. Generally, with a higher frequency of the use of the toner T in the developer container, there is a tendency that the cohesion of the toner T is made higher, so that the cohesion of the toner T in the developing device before the image forming operation is performed can be estimated that it is lower than 30%. In other words, when the toner has the cohesion of 30% or less, the toner can be used with no problem for creating the state, which is the feature of the present invention, in which the entry of the toner into the supplying roller and the exit of the toner from the supplying roller are in the equilibrium state.

The amount of the toner contained in the supplying roller shows a correlation with the remaining toner amount in the toner container. Therefore, as the self weight of the toner in the toner container is exerted on the supplying roller as it is, the correlation between the remaining toner amount in the developing device and the amount of the toner contained in the supplying roller as shown in FIG. 6(*b*) becomes high. For that reason, as in this embodiment, by employing the constitution in which the supplying roller is disposed at the opening in the toner container, the accuracy of the remaining toner amount detection can be improved. In the image forming apparatus 10 in this embodiment, the constitution in which the detector 69 for detecting the voltage induced in the developing roller 1 by applying the remaining toner amount detecting bias from the voltage source 70*a* to the supplying roller 2 was disposed was employed. However, a similar effect can be obtained even in a constitution in which a detector for detecting the voltage is induced in the supplying roller 2 by applying the remaining toner amount detecting bias to the developing roller 1 is disposed.

In the conventional constitution (JP-A Hei 4-234777), the amount of the toner contained in the supplying roller is abruptly decreased in some cases when a print ratio is high. In such cases, there is a possibility that the remaining developer amount measuring device erroneously detects no toner. In such cases, in this embodiment, the toner replenishing operation for replenishing the toner into the supplying roller by rotating the supplying roller 2 at a speed of 50 rpm which is slower than that (100 rpm) during the image formation. As a result, the toner amount in the supplying roller is stabilized, so that the presence or absence of the toner, in the developer container, usable for the image formation can be detected with high accuracy. Specifically, this phenomenon (operation) will be described with reference to FIG. 7(*b*). FIG. 7(*b*) is a graph showing a relationship between a rotation time of the supplying roller 2 and the amount of the toner contained in the urethane sponge of the supplying roller 2 when the rotation time is changed. As shown in FIG. 7(*b*), after a lapse of the rotation time of 100 seconds, it is understood that the maximum amount of the toner contained in the urethane sponge of the supplying roller 2 becomes larger with a slower rotational speed. In the present invention, this phenomenon was utilized. However, at 25 rpm, the rotation time is unnecessarily required. For this reason, in this embodiment, the contained toner amount when the supplying roller 2 is rotated at 50 rpm for 30 seconds is larger than that when the supplying roller 2 is rotated at 100 rpm for 30 seconds also during the image formation. For that reason, in this embodiment, the rotational speed used for the toner replenishing operation was set at 50 rpm. Also in this toner replenishing operation, in the case where the toner replenishing operation is performed during the image formation, there is a possibility of inhibition of image stability such as a decrease in image density, so that the remaining developer amount measuring device is operated during a period other than that for the image formation. For example, the remaining developer amount measuring device can be operated during the pre-rotation and the post-rotation before and after the image formation. In this embodiment, depending on a measurement result of the remaining developer amount measuring device, whether or not the above-described toner replenishing operation is performed is determined. In this embodiment, the developing roller 1 is rotationally driven at the rotational speed of 65 rpm which is slower than that during the image formation and the supplying roller 2 is rotationally driven at the rotational speed of 50 rpm which is slower than that during the image formation. This rotational drive is performed for 30 seconds and then the toner replenishing operation is completed. Hereinafter, the above-described operation for replenishing the toner into the supplying roller 2 is referred to as the toner replenishing operation. In this embodiment, the driving means 56, the driver 57, and the controller portion 52 constitute a replenishing device 80 for replenishing the developer into the predetermined 2 by making the rotational speed of the supplying roller 2 slower than that during the image formation.

Figure 8:
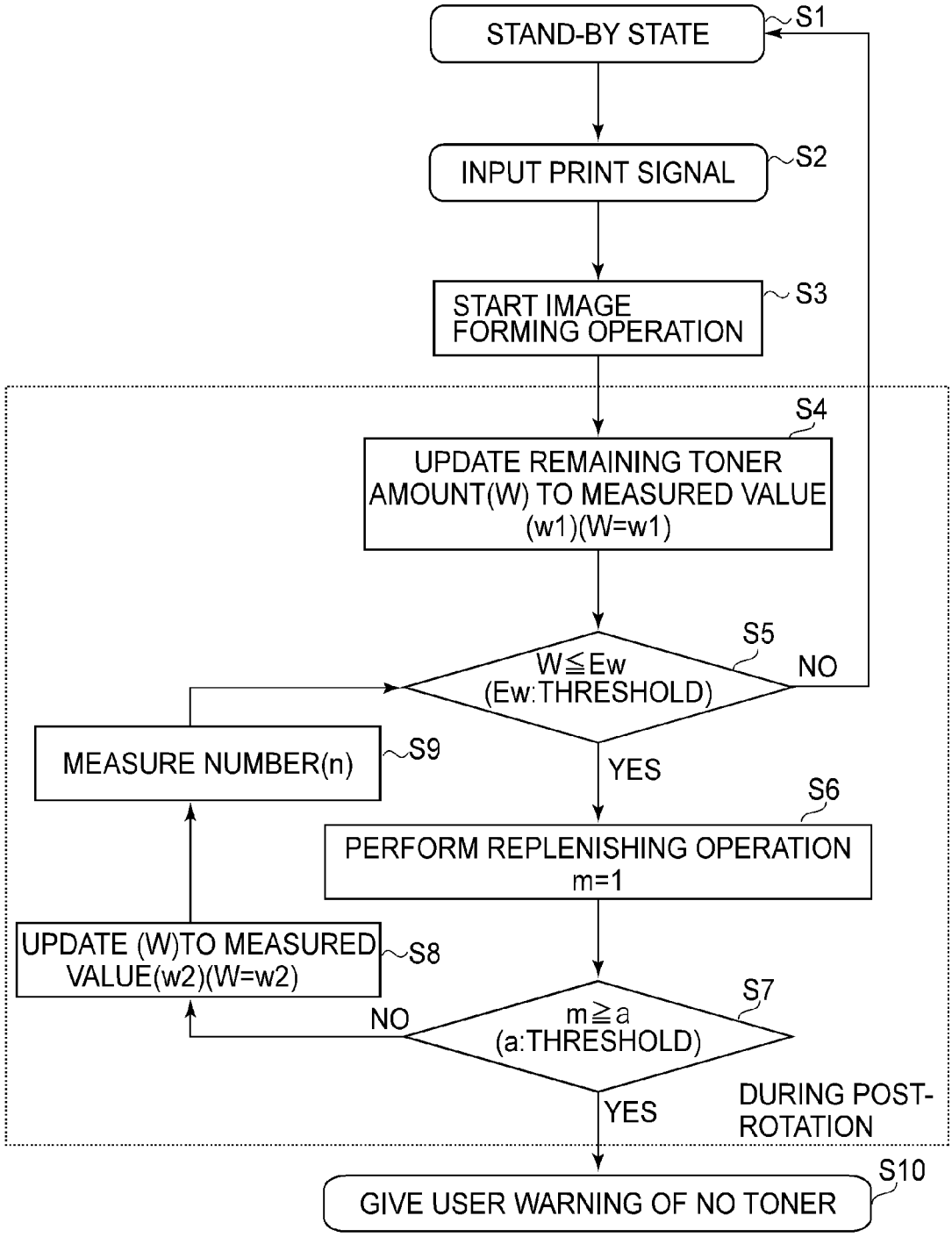
FIGS. 8, 9 and 10 are flowcharts of remaining toner amount detection in Embodiments 1, 2 and 3respectively.

That is, in the case where a measured value of the remaining developer amount by the remaining developer amount measuring device 100 is below a threshold, an operation for rotating the developer feeding member 2 at the rotational speed which is slower than that during the image formation (the operation for replenishing the toner into the supplying roller 2, i.e., the toner replenishing operation) is performed. This embodiment is characterized by executing a control mode in which the remaining developer amount is measured again by the remaining developer amount measuring device after the toner replenishing operation is performed. Hereinbelow, with reference to a flowchart of FIG. 8, an operation of a remaining toner amount detecting system using the toner replenishing operation in this embodiment will be described specifically. FIG. 8 is the flowchart of the operation of the image forming apparatus shown in FIG. 1(*a*). In this embodiment, the ROM (storing portion) 54 of the controller portion 52 can count and store the number m of executions of the toner replenishing operation by the image forming apparatus. By performing the toner replenishing operation until the number m reaches a certain value, it becomes possible to properly notify the user that there is no toner in the developer container when the toner usable in the developer container is actually used up entirely. Referring to the flowchart of FIG. 8, the image forming apparatus 10 is in a stand-by state (S1). A print signal is input into the controller portion 52 (S2). Based on this print signal, the controller portion 52 performs the image forming operation at the image forming apparatus 10. That is, the image forming apparatus 10 starts the image forming operation and effects the rotation of the developing roller 1 and the formation of the electrostatic latent image on the photosensitive drum 11 with appropriate timing (S3). During the post-rotation after the completion of the image formation, the developing device 4 is moved from the first position to the second position and then the remaining toner amount detection by the remaining developer amount measuring device 100 is performed. Then, a remaining toner amount W is updated to a measured result w1 (S4), the resultant remaining toner amount W is compared with the threshold Ew for judging that there is no toner in the developer container (S5). In the case where the remaining toner amount W is larger than the threshold Ew (NO of S5), the printing is completed and the operation goes to the stand-by state (S1). In the case where the remaining toner amount W is not more than the threshold Ew (YES Of S5), the toner replenishing operation is performed in the state in which the developing device 4 is kept at the second position (S6). Next, the number m of executions of the toner replenishing operation is compared with a threshold a (S7). In the case where the number m is smaller than the threshold a (NO of S7), the remaining toner amount detection is performed again and the remaining toner amount W is updated to a measured result w2 (S8) and then the resultant remaining toner amount W is compared with the threshold Ew for judging that there is no toner in the developer container (S5). In the case where the remaining toner amount W is larger than the threshold Ew (NO of S5), the printing is completed and the operation goes to the stand-by state (S1). In the case where the remaining toner amount W is not more than the threshold Ew (YES of S5), the toner replenishing operation is executed (S6). The above cycle is repeated and in the case where the number m is not less than the threshold a, in a display device which is a display portion or the like of the image forming apparatus 10 or the host device 51, the user is notified and warned that there is no toner in the developer container (S10). In this embodiment, the number m is 3.

By employing such a constitution, it is possible to detect the presence or absence of the toner in the developer container with high accuracy. The rotational speed of the supplying roller 2 during the toner replenishing operation can also be changed depending on an operation environment (temperature and humidity). Further, the rotational speed and rotation time of the supplying roller 2 can be set arbitrarily. Further, the toner replenishing operation is performed when the developing device 4 is located at the second position but may also be performed when the developing device 4 is located at the first position. At that time, the toner replenishing operation is required to be performed with timing other than the period of the image formation. Incidentally, in this embodiment, the remaining toner amount is measured from the electrostatic capacity as described above and then the toner replenishing operation is executed on the basis of the remaining toner amount but the measurement of the remaining toner amount itself is not essential. That is, the remaining toner amount can be measured by detecting the electrostatic capacity, so that the execution of the toner replenishing operation using the electrostatic capacity itself as a parameter is also embraced in the present invention. Further, in this embodiment, the contact development is employed but the present invention is not limited thereto and is also effective in the image forming apparatus using a non-magnetic jumping developing type or the like in which the toner supplying roller is used. Further, the present invention is similarly effective also with respect to the image forming apparatus which is configured to obtain a full-color image by arranging a plurality of process cartridges similarly as in this embodiment.

[Embodiment 2]

Next, Embodiment 2 (Second Embodiment) of the image forming apparatus according to the present invention will be described. In the following description, portions similar to those in Embodiment 1 described above will be omitted from description. In this embodiment, a storing means for storing a result of preceding measurement by the remaining developer amount measuring device 100 is included in the image forming apparatus. In FIG. 1(*a*), the ROM 54 of the controller portion 52 is the storing means. By this storing means 54, the preceding measurement result and a current measurement result can be compared with each other. As a result, it becomes possible to meet the case where the current measurement result is abruptly changed although the remaining toner amount is large in the preceding measurement. For example, in the case where the printing is effected with a high print ratio, there is possibility that the measurement result by the remaining developer amount measuring device indicates the remaining toner amount which is smaller than an actual value since the amount of the toner in the supplying roller is abruptly decreased although the toner remains in the developer container. Therefore, by replenishing the supplying roller with the toner, it becomes possible to accurately measure the presence or absence of the amount of the toner actually remaining in the developer container by the remaining developer amount measuring device.

Figure 9:
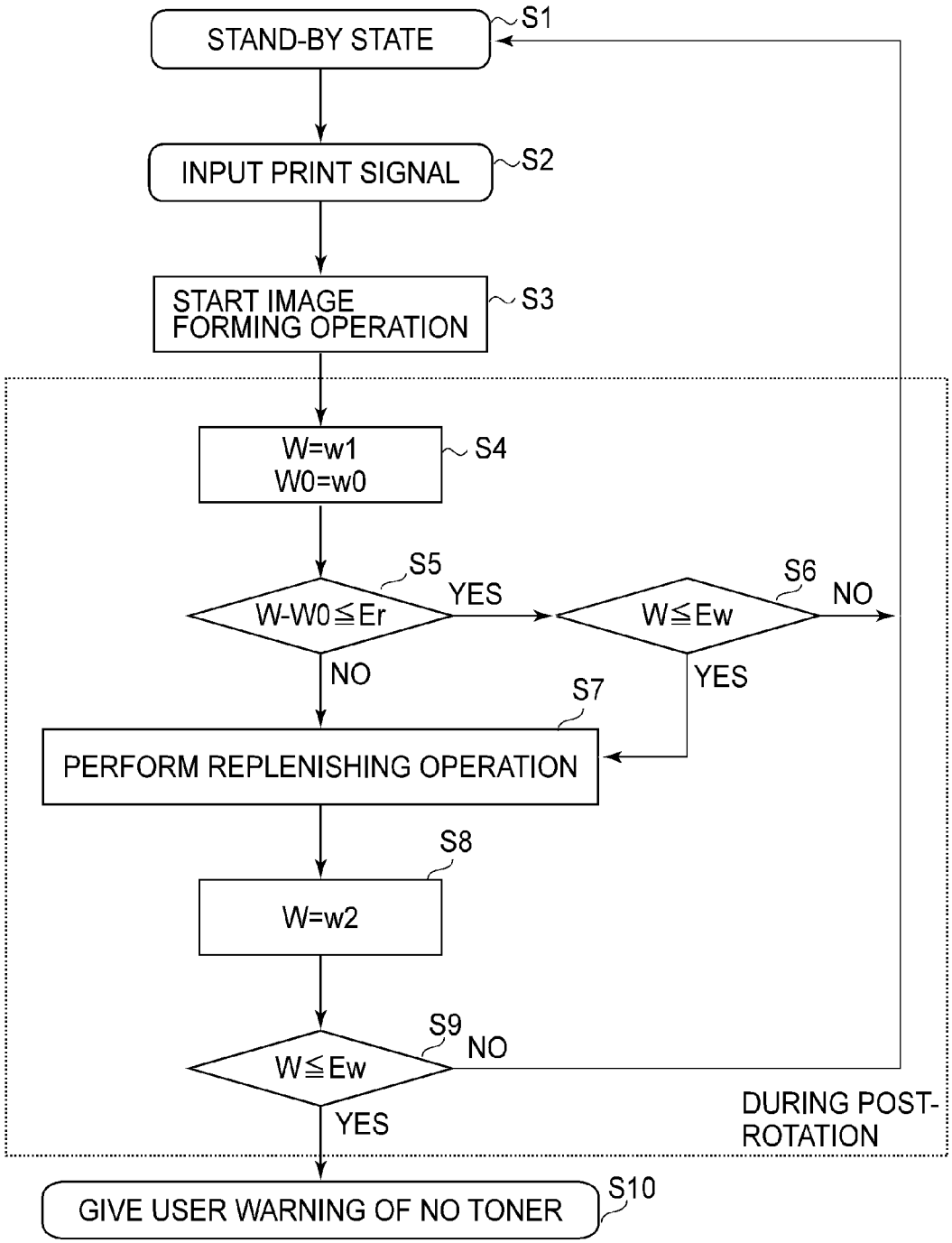

With reference to a flowchart of FIG. 9, an operation of a remaining toner amount detecting system using the toner replenishing operation in this embodiment will be described specifically below. FIG. 9 is the flowchart of the operation of the image forming apparatus shown in FIG. 1(*a*). That is, the operation for rotating the developer feeding member 2 at the rotational speed which is slower than that during the image formation, i.e., the toner replenishing operation for replenishing the toner into the supplying roller, is executed in the case where a value obtained by subtracting a measured value of the remaining developer amount in the current measurement from a measured of the remaining developer amount in the present measurement exceeds a predetermined value. This embodiment is characterized in that a control mode in which the remaining developer amount is measured again by the remaining developer amount measuring device 100 is executed after this operation. Referring to the flowchart of FIG. 9, the image forming apparatus 10 is in a stand-by state while storing a current remaining toner amount w0 (measured in preceding measurement) (S1). A print signal is input into the controller portion 52 (S2). Based on this print signal, the controller portion 52 performs the image forming operation. That is, the image forming apparatus 10 starts the image forming operation and effects the rotation of the developing roller 1 and the formation of the electrostatic latent image on the photosensitive drum 11 with appropriate timing (S3). During the post-rotation after the completion of the image formation, the developing device 4 is moved from the first position to the second position and then the remaining toner amount detection by the remaining developer amount measuring device 100 is performed. Then, a remaining toner amount W is updated to a measured result w1 (S4), and the remaining toner amount in the preceding measurement is updated to w0. First, a toner change amount W-W0 is compared with a threshold Er for judging whether or not the remaining toner amount in the supplying roller is abruptly changed. In the case where the toner change amount W-WO is not more than the threshold Er (YES of S5), the updated remaining toner amount W is compared with the threshold Ew for judging that there is no toner in the developer container (S6). In the case where the remaining toner amount W is larger than the threshold Ew (NO of S6), the printing is completed and the operation goes to the stand-by state (51). In the case where the remaining toner amount W is not more than the threshold Ew (YES Of S6), the toner replenishing operation is performed (S7). Then, the remaining toner amount detection is performed again and the remaining toner amount W is updated to a measured result w2 (S8) and then the resultant remaining toner amount W is compared with the threshold Ew for judging that there is no toner in the developer container (S9). In the case where the remaining toner amount W is larger than the threshold Ew (NO of S9), the printing is completed and the operation goes to the stand-by state (S1). In the case where the remaining toner amount W is not more than the threshold Ew (YES of S9), the user is warned that there is no toner in the developer container, at a display device such as a display portion or the like of the image forming apparatus 10 or the host device 51 (S10). On the other hand, in the case where the toner change amount W-WO is larger than the threshold Er (NO of S5), the toner replenishing operation is executed (S7). Then, the remaining toner amount detection is performed again and the remaining toner amount W is updated to a measured result w2 (S8). The updated remaining toner amount W is compared with the threshold Ew for judging that there is no toner in the developer container (S9). In the case where the remaining toner amount W exceeds the threshold Ew (NO of S9), the printing is completed and the operation goes to the stand-by state (S1). Further, in the case where the remaining toner amount W is not more than the threshold Ew (YES of S9), the user is warned that there is no toner in the developer container, at the display device such as the display portion or the like of the image forming apparatus 10 or the host device 51 (S10). Incidentally, in this embodiment, the remaining toner amount is measured from the electrostatic capacity as described above and then the toner replenishing operation is executed on the basis of the remaining toner amount but the measurement of the remaining toner amount itself is not essential.

That is, the remaining toner amount can be measured by detecting the electrostatic capacity, so that the execution of the toner replenishing operation using the electrostatic capacity itself as a parameter is also embraced in the present invention. Further, in this embodiment, the contact development is employed but the present invention is not limited thereto and is also effective in the image forming apparatus using a non-magnetic jumping developing type or the like in which the toner supplying roller is used. Further, in this embodiment, the storing means 54 for storing the result during the preceding measurement by the remaining developer amount measuring device is included in the image forming apparatus but may also be included in the process cartridge 20 which at least contains the developing device and which is detachably mountable to the image forming apparatus. By providing this storing means 54, it is possible to notify the user of the remaining toner amount. Further, the present invention is similarly effective also with respect to the image forming apparatus which is configured to obtain a full-color image by arranging a plurality of process cartridges similarly as in this embodiment.

[Embodiment 3]

Next, Embodiment 3 (Third Embodiment) of the image forming apparatus according to the present invention will be described. In the following description, portions similar to those in Embodiment 1 described above will be omitted from description. In this embodiment, the warning of the remaining toner amount is given stepwisely. At a remaining toner amount level 1 as a reference level at which the warning is given, there is a possibility that a printed character looks patchy but the possibility is eliminated by performing the toner replenishing operation in the present invention. At a remaining toner amount level 2, the printed character looks patchy even when the toner replenishing operation is performed and therefore the image formation cannot be continued with the remaining toner amount (i.e., the remaining toner amount is judged as being on toner).

Figure 10:
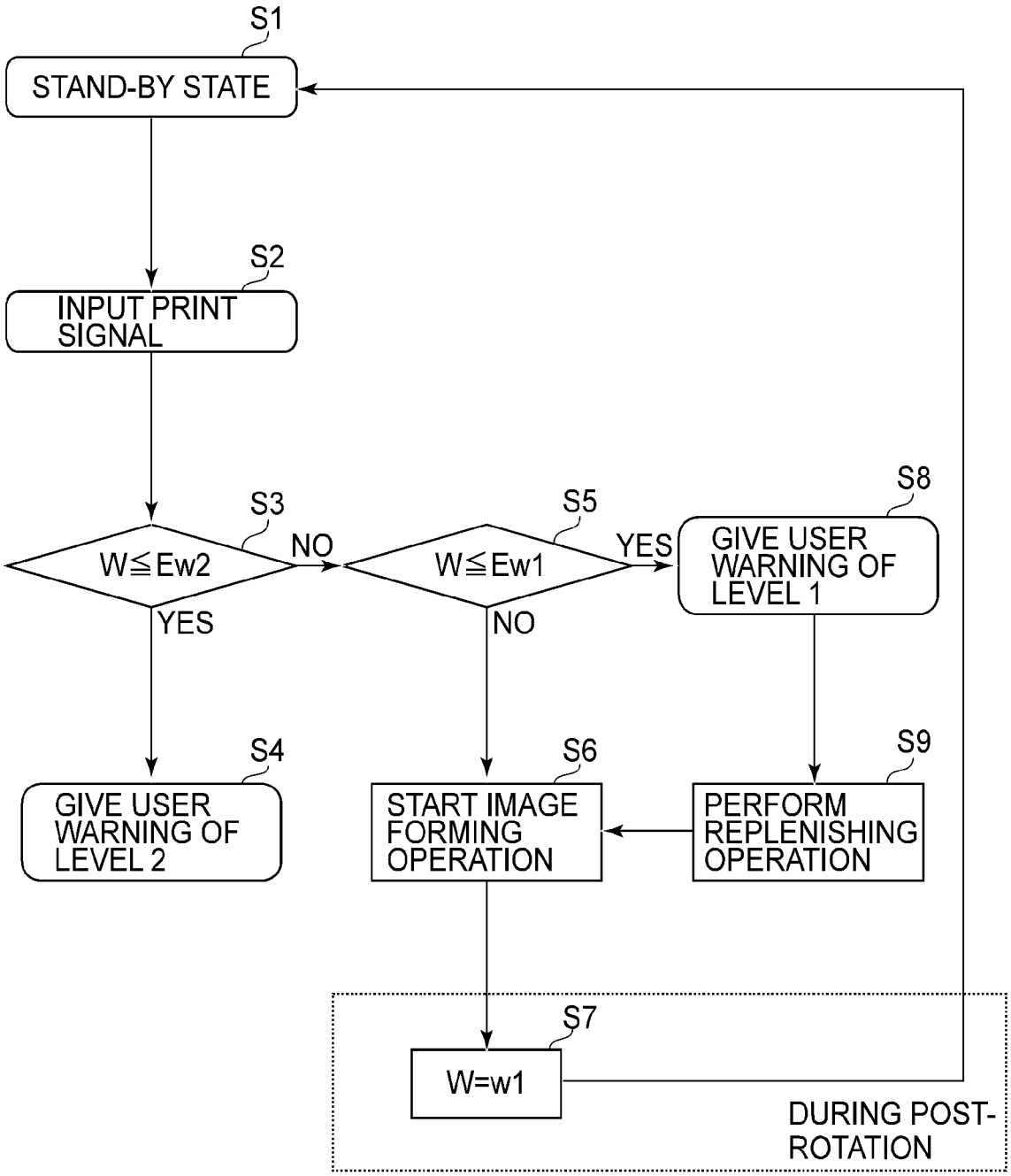

With reference to a flowchart of FIG. 10, an operation of a remaining toner amount detecting system using the toner replenishing operation in this embodiment will be described specifically below. FIG. 10 is the flowchart of the operation of the image forming apparatus shown in FIG. 1(*a*). Referring to the flowchart of FIG. 10, the image forming apparatus 10 is in a stand-by state while storing a current remaining developer amount W (measured in the preceding measurement) (S1). At this time, a print signal is input into the controller portion 52 (S2). The controller portion 52 performs the image forming operation of the image forming apparatus 10 on the basis of the print signal. Then, the current remaining toner amount W is compared with a threshold Ew2 for judging the remaining toner amount level 2 of the remaining toner amount in the developer container (S3). In the case where the remaining toner amount W is not more than the threshold Ew2 (YES of S3), the warning of the remaining toner amount level 2 of the remaining toner amount in the developer container is given to the user (S4). In the case where the remaining toner amount W is larger than the threshold Ew2(NO of S3), the remaining toner amount W is compared with a threshold Ew1 for judging the remaining toner amount level 1 of the remaining toner amount in the developer container (S5)≤In the case where the remaining toner amount W is larger than the threshold Ew1 (NO of S5), the image forming apparatus 10 starts the image forming operation and effects the rotation of the developing roller 1 and the formation of the electrostatic latent image on the drum 11 with appropriate timing (S6). The developing device 4 is moved from the first position to the second position after the completion of the image formation, and the remaining toner amount detection is performed by the remaining developer amount measuring device 100. The remaining toner amount W is updated to the measured result w1 (S7), and then the operation goes to the stand-by state (S1). In the case where the remaining toner amount W is not more than the threshold Ew1 (YES of S5), the warning of the remaining toner amount level 1 of the remaining toner amount in the developer container is given to the user (S8) and then the toner replenishing operation is performed (S9). Thereafter, the image forming apparatus 10 starts the image forming operation and effects the rotation of the developing roller 1 and the formation of the electrostatic latent image on the photosensitive drum 11 with appropriate timing. The post-rotation is performed after the completion of the image formation, and the remaining toner amount detection is performed and the remaining toner amount W is updated to the measured result w1 (S7). The operation goes to the stand-by state (S1). By employing such a constitution, even in the remaining toner amount such that the resultant character has conventionally looked patchy, a state in which the character does not look patchy is created, so that the utmost use of the toner in the toner container is made and thus the no toner state can be judged. In this embodiment, the two remaining toner amount levels described above are used but the cartridge can be exchanged depending on an image which is intended to be printed by the user by appropriately setting the remaining toner amount level. Incidentally, in this embodiment, the remaining toner amount is measured from the electrostatic capacity as described above and then the toner replenishing operation is executed on the basis of the remaining toner amount but the measurement of the remaining toner amount itself is not essential. That is, the remaining toner amount can be measured by detecting the electrostatic capacity, so that the execution of the toner replenishing operation using the electrostatic capacity itself as a parameter is also embraced in the present invention. Further, in this embodiment, the contact development is employed but the present invention is not limited thereto and is also effective in the image forming apparatus using a non-magnetic jumping developing type or the like in which the toner supplying roller is used. Further, the present invention is similarly effective also with respect to the image forming apparatus which is configured to obtain a full-color image by arranging a plurality of process cartridges similarly as in this embodiment. [Embodiment 4[

Figure 11:
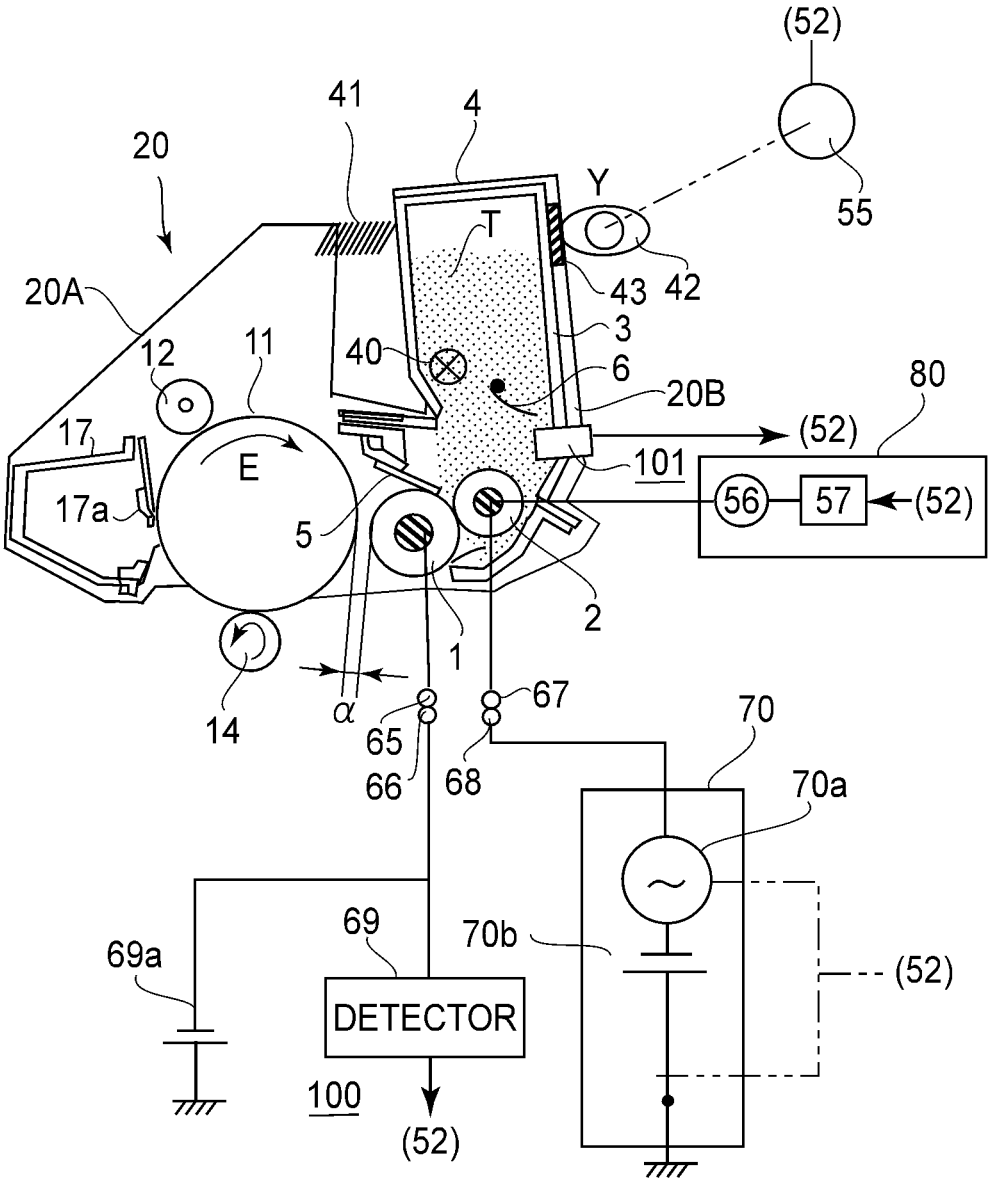
FIG. 11 is a schematic view for illustrating a constitution of the image forming apparatus in Embodiment 4.
Figure 12:
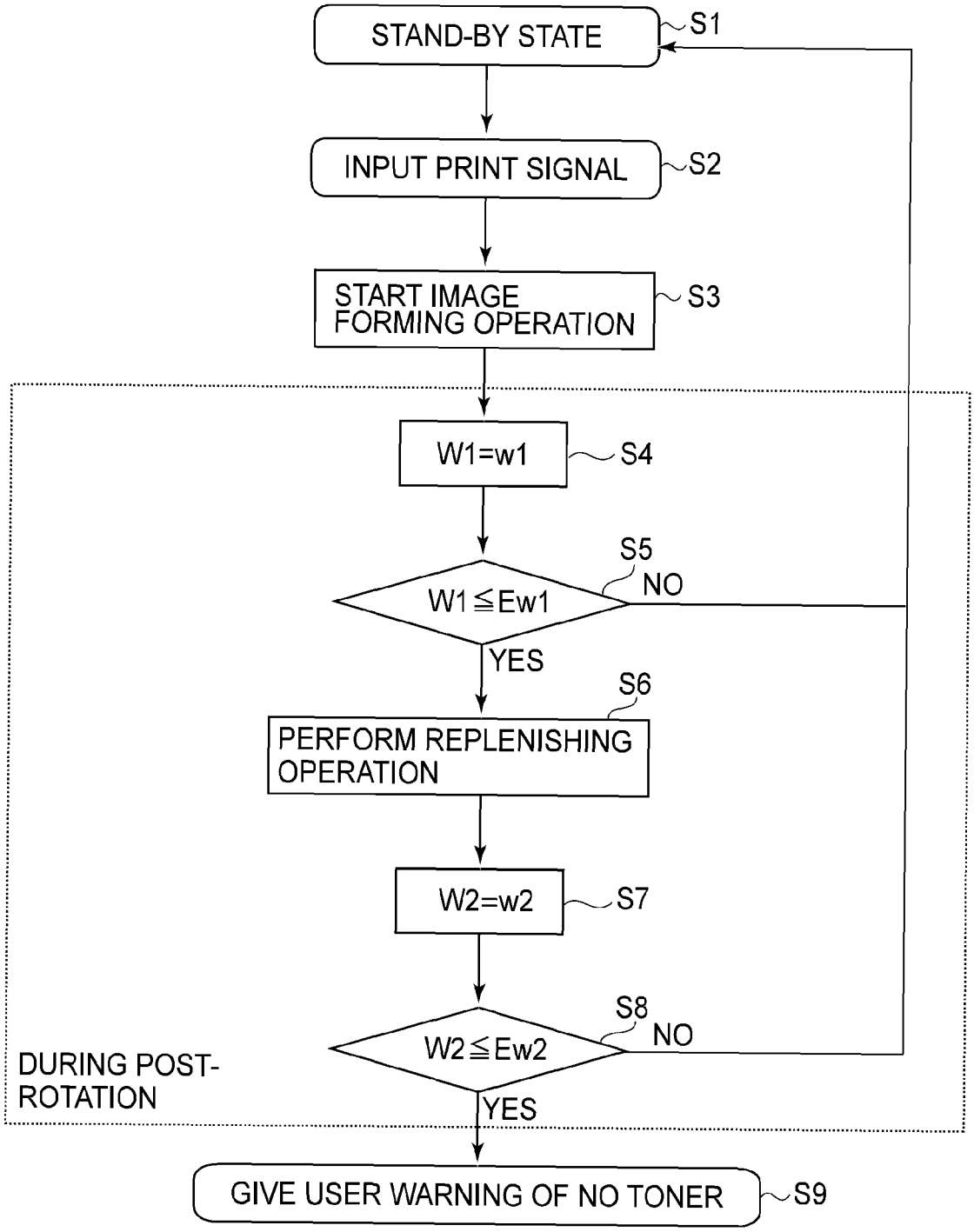
FIG. 12 is a flowchart of remaining toner amount detection in Embodiment 4.

Next, Embodiment 4 (Fourth Embodiment) of the image forming apparatus according to the present invention will be described. In the following description, portions similar to those in Embodiment 1 described above will be omitted from description. The image forming apparatus includes a first remaining developer amount measuring device as a first measuring means and a second remaining developer amount measuring device as a second measuring means. In this embodiment, as shown in FIG. 11, the developing device 4 includes an optical remaining developer amount measuring device as a first remaining developer amount measuring device (first remaining toner amount measuring device) 101. This optical remaining developer amount measuring device 101 measures the remaining toner amount by measuring an amount of light passing through the toner T which has been irradiated with laser light when the toner T in the developer container 3 is stirred by a stirring member 6. Detection information by this measuring device 101 is input into the controller portion 52. Further, the image forming apparatus includes, as the second remaining developer amount measuring device (second remaining toner amount measuring device), a remaining developer amount measuring device 100 which utilizes the change in electrostatic capacity and which has the same constitution as that in Embodiment 1. Further, in this embodiment, in the case where a measured value of the remaining developer amount by the first remaining developer amount measuring device 101 is not more than a threshold, the operation for rotating the developer feeding member 2 at a rotational speed which is slower than that during the image formation is executed. That is, the operation for replenishing the toner into the supplying roller (toner replenishing operation) is executed. This embodiment is characterized by a control mode in which remaining developer amount measurement by the second remaining developer amount measuring device 100 is carried out after the execution of the toner replenishing operation. With referenced to the flowchart of FIG. 12, an operation of the remaining toner amount detecting system using the toner replenishing operation in this embodiment will be described specifically below. FIG. 12 is the flowchart of the operation of the image forming apparatus shown in FIG. 1(*a*) and FIG. 11. Referring to the flowchart of FIG. 12, the image forming apparatus 10 is in a stand-by state (S1). At this time, a print signal is input into the controller portion 52 (S2). Based on this print signal, the controller portion 52 performs the image forming operation of the image forming apparatus 10. That is, the image forming apparatus 10 stars the image forming operation and effects the rotation of the developing roller 1 and the formation of the electrostatic latent image on the photosensitive drum 11 with appropriate timing (S3). After the completion of the image formation, the first remaining developer amount measuring device 101 is operated and a remaining toner amount W1 in a first remaining developer amount starting means (not shown), for storing a measured result of the remaining developer amount by the first remaining developer amount measuring device, included in the image forming apparatus is updated to the measured result w1 (S4). Then, updated remaining developer amount W1 is compared with a threshold Ew1 for judging that the toner in the developer container is small (S5). In the case where the remaining toner amount W1 is larger than the threshold Ew1 (YES Of S5), the printing is completed and the operation goes to the stand-by state (S1). In the case where the remaining toner amount W1 is not more than the threshold Ew1 (NO of S5), the toner replenishing operation is performed 8S6). Next, the second remaining developer amount measuring device 100 utilizing the electrostatic capacity is operated and a remaining toner amount W2 in a second remaining developer amount storing means (not shown) included in the image forming apparatus is updated to a measured result w2(S7). The second remaining developer amount storing means stores a measured result of the remaining developer amount by the second remaining developer amount measuring device. Then a resultant remaining toner amount W2 is compared with the threshold Ew for judging that there is no toner in the developer container (S8). In the case where the remaining toner amount W2 is larger than the threshold Ew2 (NO of S9), 8the printing is completed, and the operation goes to the stand-by state (S1). In the case where the remaining toner amount W2 is not more than the threshold Ew2 (YES of S8), the user is warned that there is no toner in the developer container (S9).

By employing such a constitution, the no toner state in the developer container can be accurately detected. In this embodiment, as the first remaining developer amount measuring device 101, the optical remaining developer amount measuring device for measuring the remaining toner amount by measuring the amount of light passing through the toner which had been irradiated with laser light during the stirring of the toner was described. However, the first remaining developer amount measuring device 101 is not limited to the optical remaining developer amount measuring device. For example, as the first remaining developer amount measuring device 101, an image dot type remaining developer amount measuring device (the remaining developer amount measuring device using the number of image dots) for measuring the remaining toner amount by counting the number of image dots formed on the drum can be used. Further, as the first remaining developer amount measuring device 101, an antenna type remaining developer amount measuring device (an electrostatic capacity measuring device using the antenna) for measuring the remaining toner amount by providing a metal antenna in the developer container and then by measuring the electrostatic capacity can be used. Also in other methods, it becomes possible to accurately notify the user of the no toner state in the developer container when a threshold can be set for the remaining developer amount measuring means and then the toner replenishing operation can be performed. In this embodiment, the first and second remaining developer amount storing means are provided in the image forming apparatus. However, these storing means may also be provided in the process cartridge which at least contains the developing device and which is detachably mountable to the image forming apparatus. Further, in this embodiment, the remaining toner amount is measured from the electrostatic capacity as described above and then the toner replenishing operation is executed on the basis of the remaining toner amount but the measurement of the remaining toner amount itself is not essential. That is, the remaining toner amount can be measured by detecting the electrostatic capacity, so that the execution of the toner replenishing operation using the electrostatic capacity itself as a parameter is also embraced in the present invention. Further, in this embodiment, the contact development is employed but the present invention is not limited thereto and is also effective in the image forming apparatus using a non-magnetic jumping developing type or the like in which the toner supplying roller is used. Further, the present invention is similarly effective also with respect to the image forming apparatus which is configured to obtain a full-color image by arranging a plurality of process cartridges similarly as in this embodiment.

Figure 13:
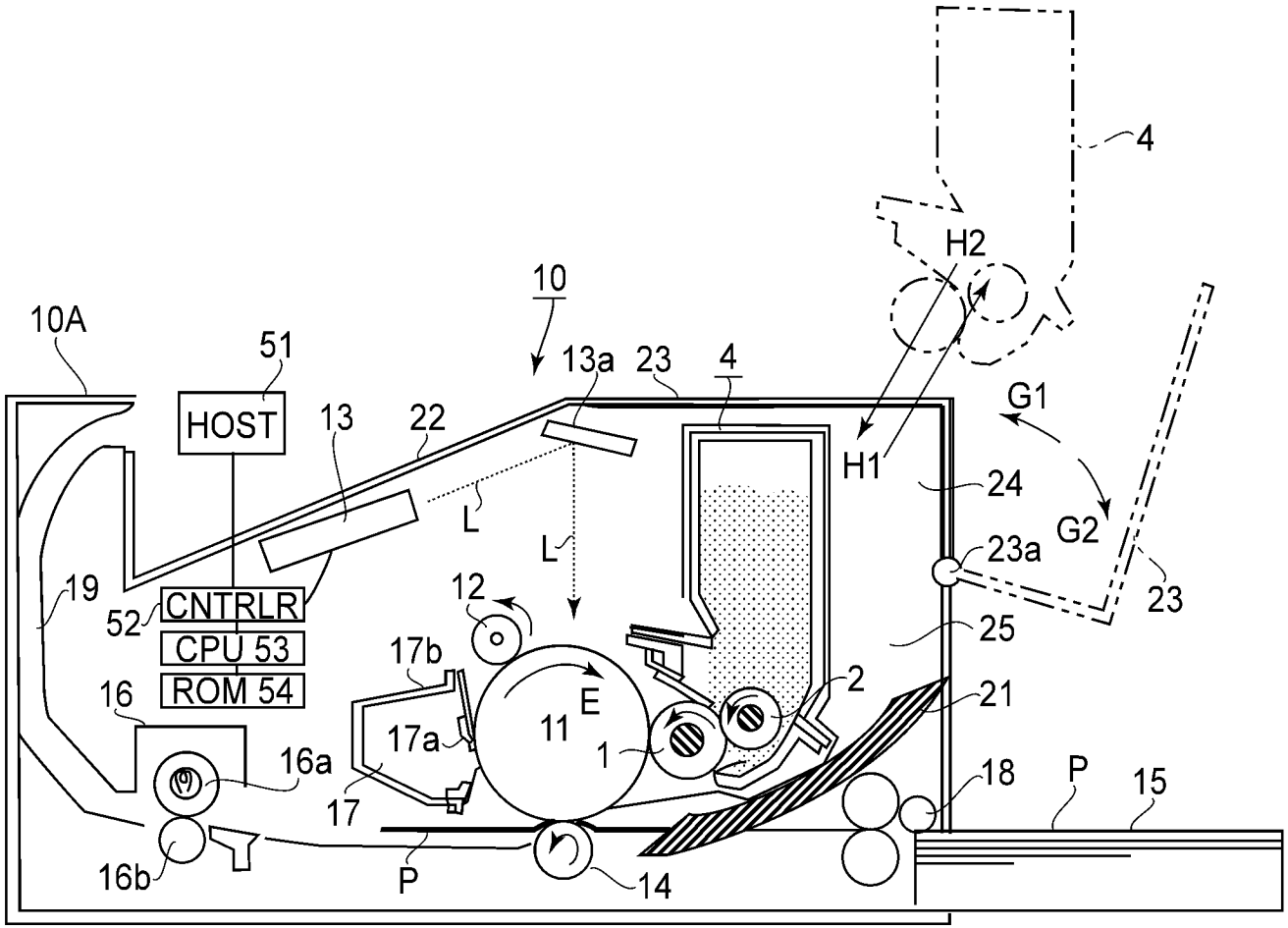
FIG. 13 is a schematic view for illustration a constitution of the image forming apparatus in Embodiment 5.

Incidentally, the image forming apparatus of the present invention is not limited to those of the process cartridge mounting and demounting type in Embodiments 1 to 4. As shown in FIG. 13, the image forming apparatus 10 in which the developing device 4 is used as a developing cartridge and is configured so as to be detachably and replaceable mountable to the apparatus main assembly 10A may also be employed. Also in this case, by employing the developing device swing constitution and the remaining developer amount measuring device constitution similarly as in the image forming apparatuses in Embodiments 1 to 4, it is possible to detect the remaining developer amount in the developing device 4 and the presence or absence of the developer with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 234004/2009 filed Oct. 8, 2009, which is hereby incorporated by reference.

What is claimed is:

1. An image forming apparatus comprising:

an image bearing member on which an electrostatic latent image is to be formed;

a developing device for developing the electrostatic latent image by supplying a developer to said image bearing member, said developing device including: a developer container for containing the developer; a rotatable developer carrying member, including a first electrode member, for carrying and supplying the developer to said image bearing member; and a developer supplying member, which is provided in contact with said developer carrying member and includes a surface foam layer and a second electrode member for rotatably supporting said developer supplying member, for supplying the developer to said developer carrying member;

a measuring device capable of measuring a remaining developer amount in said developer container by detecting electrostatic capacity between the first electrode member and the second electrode member; and a replenishing device for performing a replenishing operation for replenishing said developer supplying member with the developer by rotating said developer supplying member at a speed slower than that during image formation, wherein when the remaining developer amount measured by said measuring device is not more than a threshold, the replenishing operation is performed by said replenishing device and thereafter the remaining developer amount is measured again by said measuring device.

2. An apparatus according to claim 1, wherein the replenishing operation is performed by said replenishing device also when a value obtained by subtracting the remaining developer amount measured by said measuring device in current measurement from the remaining developer amount measured by said measuring device in a preceding measurement exceeds a predetermined value, and thereafter the remaining developer amount is measured again by said measuring device.

3. An apparatus according to claim 1, wherein when the number of executions of the replenishing operation is smaller than a predetermined number, the remaining developer amount is measured again by said measuring device and is updated to a measured value.

4. An apparatus according to claim 1, wherein the remaining developer amount is compared with a second threshold for judging that there is no developer in the developer container.

5. An apparatus according to claim 1, wherein when the remaining developer amount is larger than the threshold, said image forming apparatus is placed in a stand-by state.

6. An apparatus according to claim 1, wherein the replenishing operation is performed during post-rotation.

7. An apparatus according to claim 1, wherein when the remaining developer amount measured by said measuring device is more than the threshold, the replenishing operation is not performed by said replenishing device.

8. An image forming apparatus comprising:

an image bearing member on which an electrostatic latent image is to be formed;

a developing device for developing the electrostatic latent image by supplying a developer to said image bearing member, said developing device including: a developer container for containing the developer; a rotatable developer carrying member, including a first electrode member, for carrying and supplying the developer to said image bearing member; and a developer supplying member, which is provided in contact with said developer carrying member and includes a surface foam layer and a second electrode member for rotatably supporting said developer supplying member, for supplying the developer to said developer carrying member;

a first measuring device for measuring a remaining developer amount in said developer container;

a second measuring device capable of measuring the remaining developer amount by detecting electrostatic capacity between the first electrode member and the second electrode member; and a replenishing device for performing a replenishing operation for replenishing said developer supplying member with the developer by rotating said developer supplying member at a speed slower than that during image formation, wherein when the remaining developer amount measured by said first measuring device is not more than a threshold, the replenishing operation is performed by said replenishing device and thereafter the remaining developer amount is measured by said second measuring device.

9. An apparatus according to claim 8, wherein when the number of executions of the replenishing operation is smaller than a predetermined number, the remaining developer amount is measured by said second measuring device and is updated to a measured value.

10. An apparatus according to claim 8, wherein the remaining developer amount is compared with a second threshold for judging that there is no developer in the developer container.

11. An apparatus according to claim 8, wherein when the remaining developer amount is larger than the threshold, said image forming apparatus is placed in a stand-by state.

12. An apparatus according to claim 8, wherein the replenishing operation is performed during post-rotation.

13. An apparatus according to claim 8, wherein when the remaining developer amount measured by said first measuring device is more than the threshold, the replenishing operation is not performed by said replenishing device.

* * * * *